United States Patent [19]

Douglas et al.

[11] Patent Number: 4,963,736

[45] Date of Patent: Oct. 16, 1990

[54] MASS SPECTROMETER AND METHOD AND IMPROVED ION TRANSMISSION

[75] Inventors: Donald J. Douglas, Toronto; John B. French, Oakville, both off, Canada

[73] Assignee: MDS Health Group Limited, Etobicoke, Canada

[21] Appl. No.: 437,047

[22] Filed: Nov. 15, 1989

[30] Foreign Application Priority Data

Dec. 12, 1988 [CA] Canada ..... 585694

[51] Int. Cl.[5] ..... H01J 49/42

[52] U.S. Cl. ..... 250/292; 250/288; 250/282

[58] Field of Search ..... 250/292, 290, 281, 282, 250/288, 288 A

[56] References Cited

U.S. PATENT DOCUMENTS 4,328,420 5/1982 French ..... 250/292

4,842,701 6/1989 Smith et al. ..... 250/288

*Primary Examiner*—Jack I. Berman

*Attorney, Agent, or Firm*—Rogers, Bereskin & Parr

[57] ABSTRACT

In a mass spectrometer system, ions travel through an orifice in an inlet plate into a first vacuum chamber containing AC-only rods, and then through an orifice into a second vacuum chamber containing a standard quadrupole. The second vacuum chamber is held at low pressure, e.g. 0.02 millitorr or less, but the product of the pressure in the first chamber times the length of the AC-only rods is held above $2.25\times10^{-2}$ torr cm, preferably between $6\times10^{-2}$ and $15\times10^{-2}$ torr cm, and the DC voltage between the inlet plate and the AC-only rods is kept low, e.g. between 1 and 30 volts, preferably between 1 and 10 volts. This produces a large enhancement in ion signal, with less focussing aberration and better sensitivity at high masses, and also allows the use of smaller, cheaper pumps so the system can be more easily transportable.

24 Claims, 14 Drawing Sheets

MASS SPECTROMETER AND METHOD AND IMPROVED ION TRANSMISSION

FIELD OF THE INVENTION

This invention relates to a mass analyzer, and to a method of operating a mass analyzer, of the kind in which ions are transmitted through a first rod set for focussing and separation from an accompanying gas, before passing through a mass filter rod set which permits transmission only of ions of a selected mass to charge ratio.

BACKGROUND OF THE INVENTION

Mass spectrometry is commonly used to analyze trace substances. In such analysis, firstly ions are produced from the trace substance to be analyzed. As shown in FIGS. 13 and 14 of U.S. Pat. No. 4,328,420 to J. B. French, such ions may be directed through a gas curtain into an AC-only set of quadrupole rods. The AC-only rods serve to guide the ions into a second quadrupole rod set which acts as a mass filter and which is located behind the AC-only rods. The AC-only rod set also separates as much gas as possible from the ion flow, so that as little gas as possible will enter the mass filter. The AC-only rods therefore perform the functions both of ion optic elements and of an ion-gas separator.

In the past, it had been believed and the evidence has shown, that ion transmission through ion optical elements including AC-only rods and through a small orifice at the end of such optical elements, increases with lowered gas pressure in the ion optic elements. For example the classical equation for a scattering cell shows that the ion signal intensity (ion current) transmitted through the cell decreases with increasing gas pressure in the cell. Unfortunately the resultant need for low pressures in the region of the ion optic elements has in the case of gassy ion sources required the use of large and expensive vacuum pumps. This greatly increases the cost of the instrument and reduces its portability.

The inventors have now discovered that the classical equation describing ion signal intensity does not in fact describe the situation accurately when dynamic focussing is used in the interstage region and that when the gas pressure in the region of the ion optic elements is increased within certain limits and when the other operating conditions are appropriately established, ion transmission is markedly increased. The reasons for this are not fully understood but the effects in some cases are dramatic. In addition, when such increased pressures are used under appropriate conditions, as will be described, focussing aberration of the ion optics is reduced. In addition the ion energy spreads are reduced.

In one of its broadest aspects the invention provides a mass spectrometer system comprising:

(a) first and second vacuum chambers separated by a wall, said first vacuum chamber having an inlet orifice therein, (b) means for generating ions of a trace substance to be analyzed and for directing said ions through said inlet orifice into said first vacuum chamber, (c) a first rod set in said first vacuum chamber extending along at least a substantial portion of the length of said first vacuum chamber, and a second rod set in said second vacuum chamber, each rod set comprising a plurality of elongated parallel rod means spaced laterally apart a short distance from each other to define an elongated space therebetween extending longitudinally through such rod set, said elongated spaces of said first and second rod sets being first and second spaces respectively, said first rod set being located end to end with said second rod set so that said first and second spaces are aligned, (d) an interchamber orifice located in said wall and aligned with said first and second spaces so that ions may travel through said inlet orifice, through said first space, through said interchamber orifice, and through said second space, (e) means for applying essentially an AC-only voltage between the rod means of said first rod set so that said first rod set may guide ions through said first space, (f) means for applying both AC and DC voltages between the rod means of said second rod set so that said second rod set may act as a mass filter for said ions, (g) means for flowing gas through said inlet orifice into said first space, (h) means for pumping said gas from each of said chambers, (i) the pressure in said second chamber being a very low pressure for operation of said second rod set as a mass filter, (j) the product of the pressure in said first chamber times the length of said first rod set being equal to or greater than $2.25\times10^{-2}$ torr cm but the pressure in said first chamber being below that pressure at which an electrical breakdown will occur between the rod means of said first rod set, (k) and means for maintaining the kinetic energies of ions moving from said inlet orifice to said first rod set at a relatively low level, whereby to provide improved transmission of ions through said interchamber orifice.

In another of its broadest aspects the invention provides a method of mass analysis utilizing a first rod set and a second rod set located in first and second vacuum chambers respectively, said first and second rod sets each comprising a plurality of rod means and defining longitudinally extending first and second spaces respectively located end-to-end with each other and separated by an interchamber orifice so that an ion may travel through said first space, said interchamber orifice and said second space, said method comprising:

(a) producing outside said first chamber ions of a trace substance to be analyzed, (b) directing said ions through an inlet orifice in an inlet wall into said first space, and through said first space, said interchamber orifice and then through said second space, and then detecting the ions which have passed through said second space, to analyze said substance, (c) placing an essentially AC-only RF voltage between the rod means of said first set so that said first rod set acts to guide ions therethrough, (d) placing AC and DC voltages between the rod means of said second rod set so that said second rod set acts as a mass filter, (e) admitting a gas into said first chamber with said ions, (f) pumping said gas from said first chamber to maintain the product of the pressure in said first chamber times the length of said first rod set at or greater than $2.25\times10^{-2}$ torr cm but maintaining the pressure in said first chamber below that pressure at which an electrical breakdown would occur between the rods of said first set, (g) pumping gas from said second chamber to maintain the pressure in said second chamber at a substantially lower pressure than that of said first chamber, for effective mass filter operation of said second rod set, (h) and controlling the kinetic energy of ions entering said first rod set to maintain such kinetic energy at a relatively low value;

whereby to provide improved transmission of ions through said interchamber orifice.

Further objects and advantages and advantages of the invention will appear from the following description, taken together with the accompanying drawings.

DETAILED DESCRIPTION OF PREFERRED EMBODIMENTS

Figure 1:
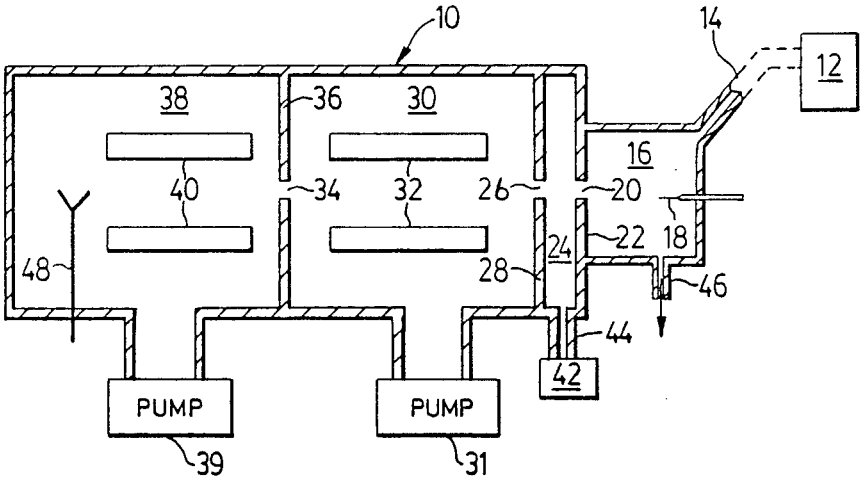
FIG. 1 is a diagrammatic view of a mass analyzer system according to the invention.
Figure 13:
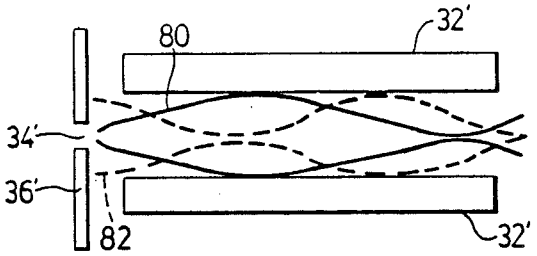
FIG. 13 is an enlarged view of the AC-only rods of FIG. 12 showing two ion trajectory envelopes therein.
Figure 14:
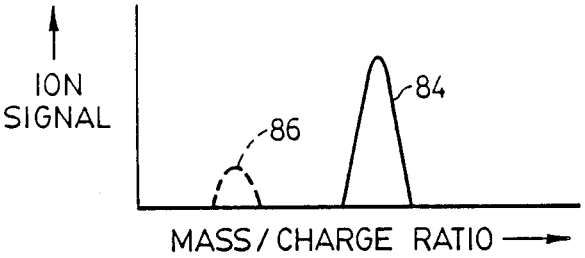
FIG. 14 is a diagrammatic mass spectrum for the two ions of FIG. 13.

Reference is first made to FIG. 1, which shows schematically a mass analyzer 10 similar in concept to that shown in FIGS. 13 and 14 of above mentioned U.S. Pat. No. 4,328,420. In the FIG. 1 arrangement, a sample gas or liquid containing a trace substance to be analyzed is introduced from a sample supply chamber 12 via a duct 14 to an ionization chamber 16 which is fitted with an electric discharge needle 18 or other means of producing gaseous ions of the trace substances (e.g. electrospray). The chamber 16 is maintained at approximately atmospheric pressure and the trace substance is ionized by electric discharge from the needle 18 or other ionizing means.

The ionization chamber 16 is connected via an opening 20 in a curtain gas plate 22 to a curtain gas chamber 24. The curtain gas chamber 24 is connected by an orifice 26 in orifice plate 28 to a first vacuum chamber 30 pumped by a vacuum pump 31. The vacuum chamber 30 contains a set of four AC-only quadrupole mass spectrometer rods 32.

The vacuum chamber 30 is connected by an interchamber orifice 34 in a separator plate 36 to a second vacuum chamber 38 pumped by a vacuum pump 39. Chamber 38 contains a set of four standard quadrupole mass spectrometer rods 40.

An inert curtain gas, such as nitrogen, argon or carbon dioxide, is supplied via a curtain gas source 42 and duct 44 to the curtain gas chamber 24. (Dry air can also be used in some cases.) The curtain gas flows through orifice 26 into the first vacuum chamber 30 and also flows into the ionization chamber 16 to prevent air and contaminants in such chamber from entering the vacuum system. Excess sample, and curtain gas, leave the ionization chamber 16 via outlet 46.

Ions produced in the ionization chamber 16 are drifted by appropriate DC potentials on plates 22, 28 and on the AC-only rod set 32 through opening 20 and orifice 26, and then are guided through the AC-only rod set 32 and interchamber orifice 34 into the rod set 40. An AC RF voltage (typically at a frequency of about 1 Megahertz) is applied between the rods of rod set 32, as is well known, to permit rod set 32 to perform its guiding and focussing function. Both DC and AC RF voltages are applied between the rods of rod set 40, so that rod set 40 performs its normal function as a mass filter, allowing only ions of selected mass to charge ratio to pass therethrough for detection by ion detector 48.

The above structure and its operation as so far described are essentially the same as those described in said U.S. Pat. No. 4,328,420. In both cases it is advantageous that the pressure in vacuum chamber 38 containing the mass spectrometer rods 40 be very low, e.g. between $2\times10^{-5}$ and $1\times10^{-6}$ torr or less. However in the past, it had always also been thought necessary to maintain a low pressure in the first vacuum chamber 30. This was thought advantageous partly to reduce the flow of gas into vacuum chamber 38, and partly simply to increase the transmission of ions through chamber 30. In fact the above mentioned U.S. patent is for a structure in which the AC-only rods are open, to improve the separation of ions from the gas in the first vacuum chamber 30.

Typically the pressure in first chamber 30 has been maintained at about $2.5\times10^{-4}$ torr (0.25 millitorr) or less. Observations have indicated that if the pressure is increased from this level, then the ion signal transmission falls off substantially.

The traditional use of low pressure in the AC-only rod section is exemplified in two papers by Dr. Dick Smith and coworkers at Pacific Northwest Laboratory, operated by Battelle Memorial Institute. The papers are: "On-Line Mass Spectrometric Detection for Capillary Zone Electrophoresis", Anal. Chem., Vol. 59, p 1230 (Apr. 15, 1987) and "Capillary Zone Electrophoresis—Mass Spectrometry Using an Electrospray Ionization Interface", Anal. Chem., Vol. 60, p 436 (March 1, 1988). The first paper shows operation of the AC-only rod set at $8\times10^{-4}$ torr. The second, more recent, paper shows operation of the AC-only rod set at $1\times10^{-6}$ torr.

These past observations have been in accordance with the classic theory of an ordinary scattering cell. The equation for ion signal transmitted through an ordinary scattering cell is $I=I_0e-\sigma 1n$, where:

I= transmitted ion signal $I_0$ = initial ion current n= the number density of the gas in the scattering cell in atoms or molecules per cubic centimeter $\sigma$ = the effective scattering loss cross section of the gas ($cm^2$)

1 = length in centimeters of the scattering cell, i.e. of the quadrupole.

Figure 2:
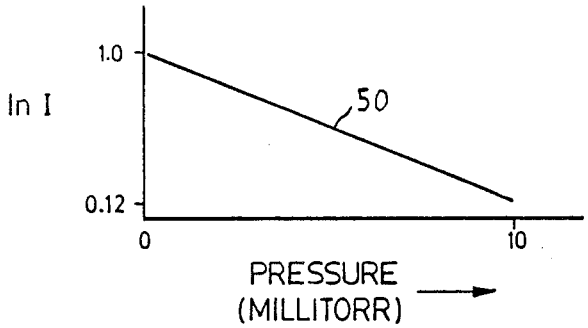
FIG. 2 is a graph showing ion signal versus pressure as predicted by the classical equation for a scattering cell.

FIG. 2, which is a plot of the natural logarithm of the transmitted ion signal on the vertical axis, versus pressure on the horizontal axis, shows in curve 50 the fall in transmitted ion signal or current which is to be expected from the classical equation. For FIG. 2 a value of $4\times10^{-16}$ cm2 was used for $\sigma$. As the pressure increases (i.e. as the number density of the gas in the cell increases), the transmitted ion current through orifice 34 falls exponentially. Actual observations in the past have verified that the ion current has tended to fall with increased pressure under the operating conditions which were used at that time.

However the applicants have determined that under appropriate operating conditions, increasing the gas pressure in the first vacuum chamber 30 not only failed to cause a decrease in the ion signal transmitted through orifice 34, but in fact most unexpectedly caused a considerable increase in the transmitted ion signal. In addition, under appropriate operating conditions, it was found that the energy spread of the ions transmitted was substantially reduced, thereby greatly improving the ease of analysis of the ion signal which is transmitted. Further, it was found that under appropriate conditions, "focussing aberration" in the ion optics (i.e. the AC-only rod set) was reduced. In other words, when the operating conditions were optimized for one mass in the mass spectrum, distortion of the responses obtained for other masses was reduced as compared with the distortion which had previously occurred.

The reasons for the above improvements are not entirely understood at present, but a description of the results so far obtained and the reasons as best known to the applicants are set forth below.

Normally the FIG. 1 apparatus would be operated with the pressure in chamber 30 at $10^{31\,4}$ torr or less, and it would be expected that as this pressure increased, the ion signal through orifice 34 would decrease, as shown in FIG. 2.

An experiment was performed with the AC-only rod set 32 replaced by an Einzel lens. In such case the transmitted ion current dropped very rapidly when the pressure was increased.

However when the same high pressure experiments were conducted using the AC-only rods 32, but with the DC difference voltage between the orifice plate 28 and the rod set 32 reduced to between about 1 and 30 volts, and preferably between 1 and 10 volts, a much different result occurred. The transmitted ion signal did not drop as the pressure increased as had been expected. Instead the ion signal increased significantly.

Figure 3:
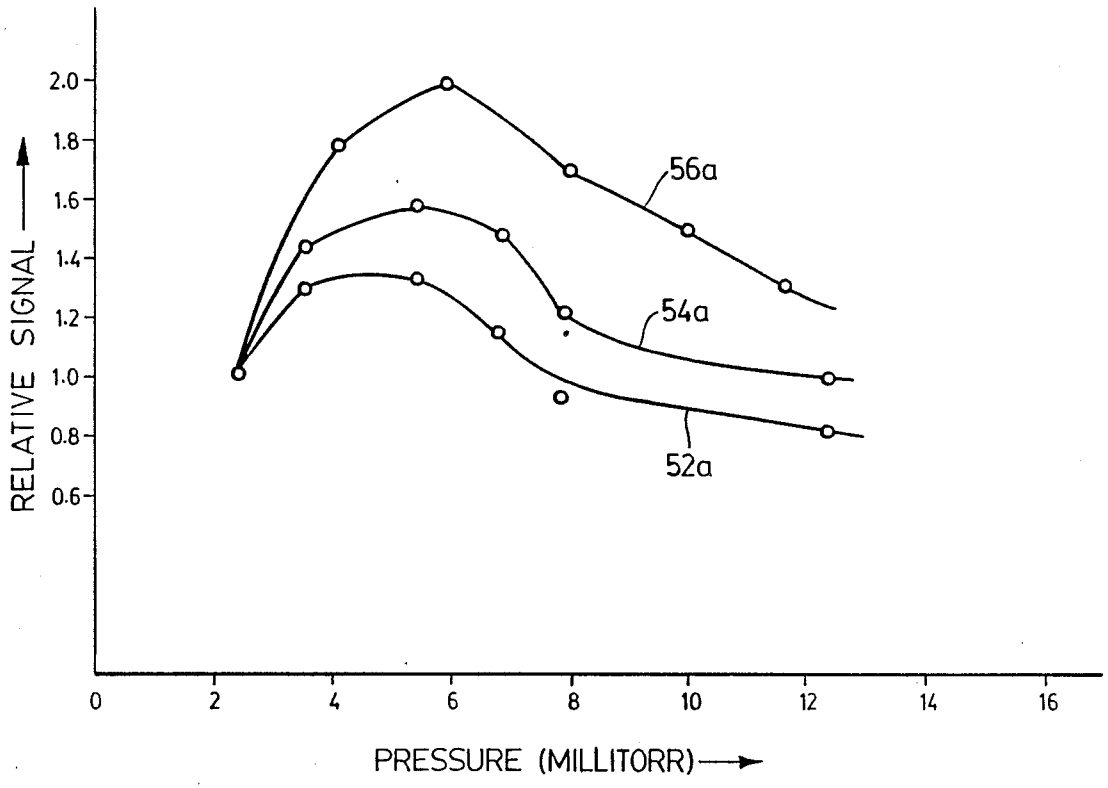
FIG. 3 is a graph showing relative ion signal versus pressure under given aperture and mass analyzer operating conditions.

This result is shown in FIG. 3, which is a graph of relative transmitted ion signal on the vertical axis, versus pressure in millitorr on the horizontal axis. The ion signal on the vertical axis is said to be "relative" in that experiments were conducted using various masses, and the ion signal at the starting point of 2.4 millitorr in all cases was normalized to 1.0.

For FIG. 3 the orifice 26 was 0.089 mm in diameter. The interchamber aperture 34 was 2.5 mm. The diameter of the inscribed circle in the first rod set 32 was 11 mm, while that of rod set 40 was 13.8 mm. The length of the AC-only rod set 32 was 15 cm and such set was operated at a Mathieu parameter q=0.65.

In FIG. 3, three curves are shown, namely curve **52*a* for mass to charge ratio (m/e) 196, curve 54*a* for m/e 391, and curve 56*a* for m/e 832. It will be seen that the maximum enhancement for each mass to charge ratio occurred at slightly different pressures, ranging from about 4.5 to 6 millitorr. The enhancement or increase in ion signal for curve 54*a* (m/e 196) was about 1.3 or 30 percent; that for curve 54*a* (m/e 391) was about 1.58 or 58 percent, and that for curve 56*a* (m/e 832**) was about 1.98 or almost a 100 percent increase in signal.

Figure 4:
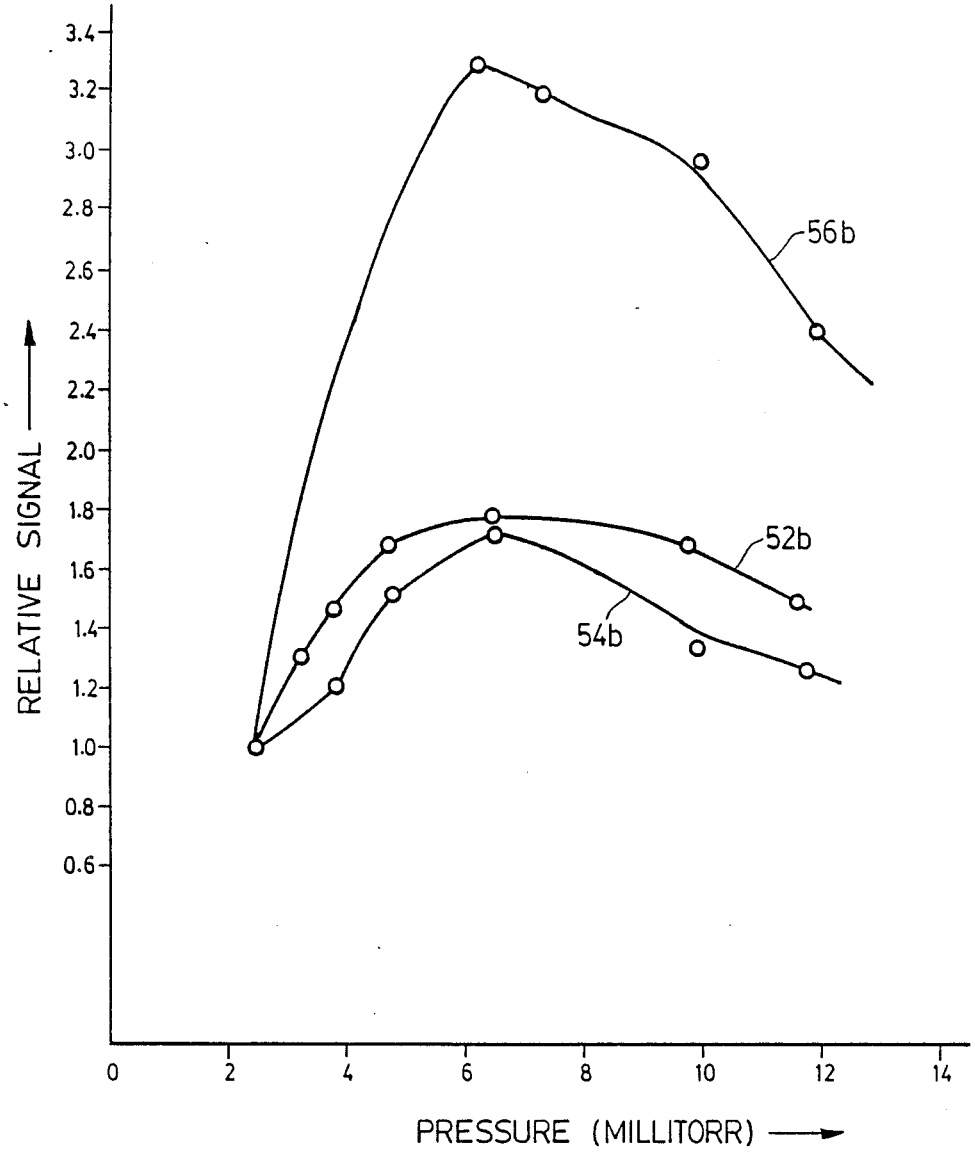
FIG. 4 is a plot similar to that of FIG. 3 but with a different "q" for the mass analyzer.

FIG. 4 is similar to FIG. 3 but shows the results when the rod set 32 was operated at q= 0.19. In FIG. 4, curve **52*b* is for m/e 196, curve 54*b* for m/e 391, and curve 56*b* for m/e 832. Here the increases in ion signal were even more marked, increasing to about 3.3 or more than 300 percent in the case of m/e 832**. This lower q involved operation of the rod set at a lower AC voltage, which reduces the likelihood of an electrical breakdown.

Figure 5:
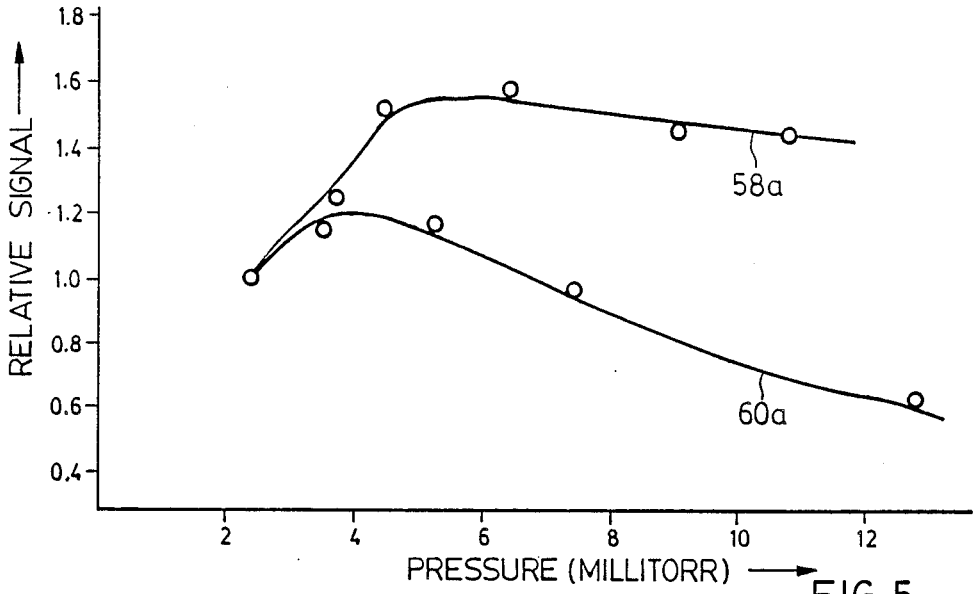
FIG. 5 is a plot of relative signal enhancement versus pressure for mass to charge ratio 196 under certain voltage conditions and for 1 mm and 2.5 mm interchamber orifices.
Figure 6:
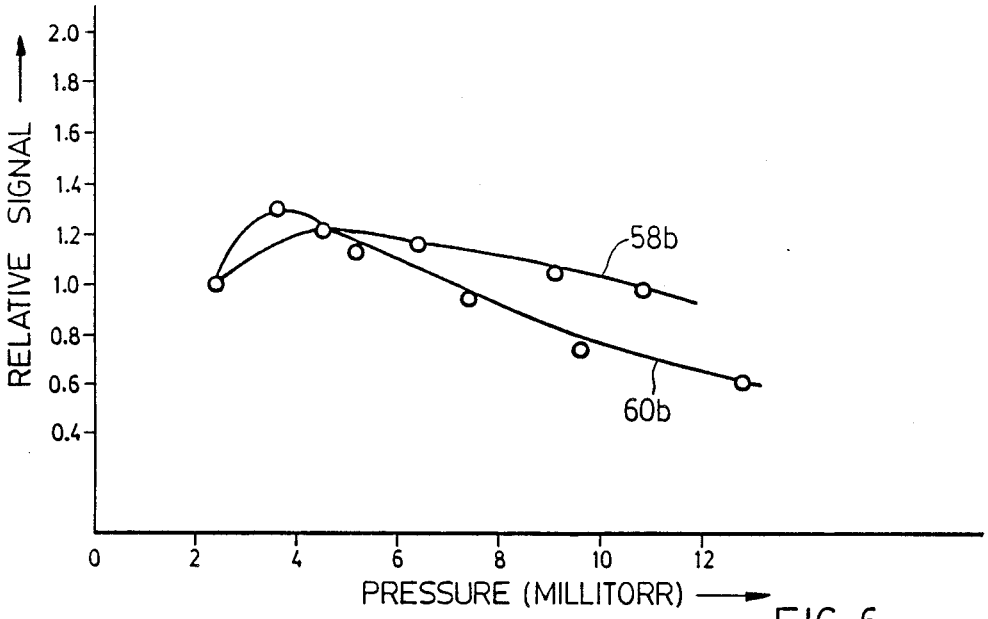
FIG. 6 is a plot similar to that of FIG. 5 but under different voltage conditions.

Reference is next made to FIGS. 5 and 6, which show the relative ion signal enhancements for m/e 196 for 1 mm and 2.5 mm diameters for orifice 26. In FIG. 5, curves **58*a* and 60*a* show how the ion signal varies with pressure for a 1 mm and 2.5 mm orifice 26 respectively, and with a 10 volt DC difference between the orifice plate 28 and the AC-only rods 32. In FIG. 6 curves 58*b*, 60*b*** show the same variation with a 15 volt difference. It will be seen that the relative enhancement in this particular case was higher for a 15 volt DC difference than for 10 volts, and in both cases was higher for a 1 mm orifice than for a 2.5 mm orifice.

Figure 7:
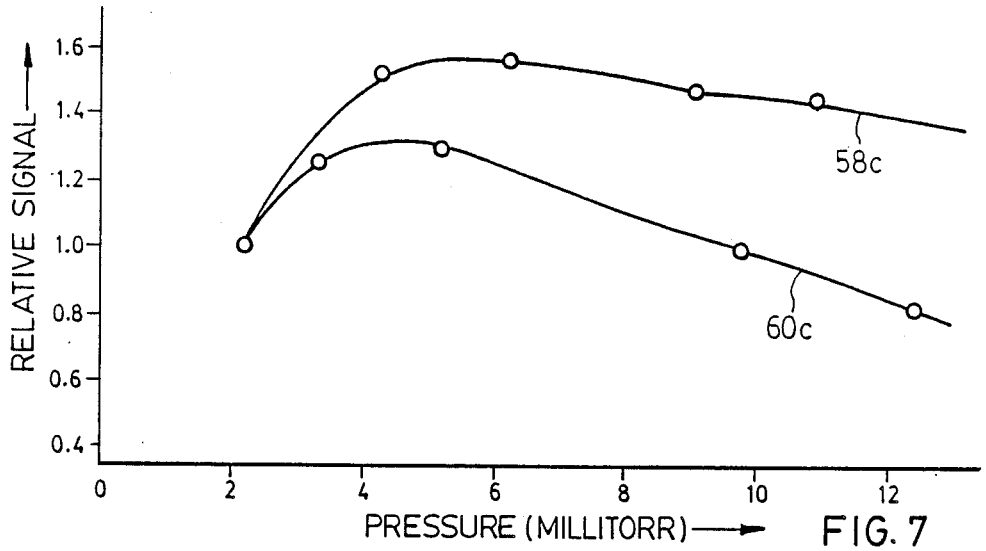
FIG. 7 is a plot similar to that of FIG. 5 but for mass 391.
Figure 8:
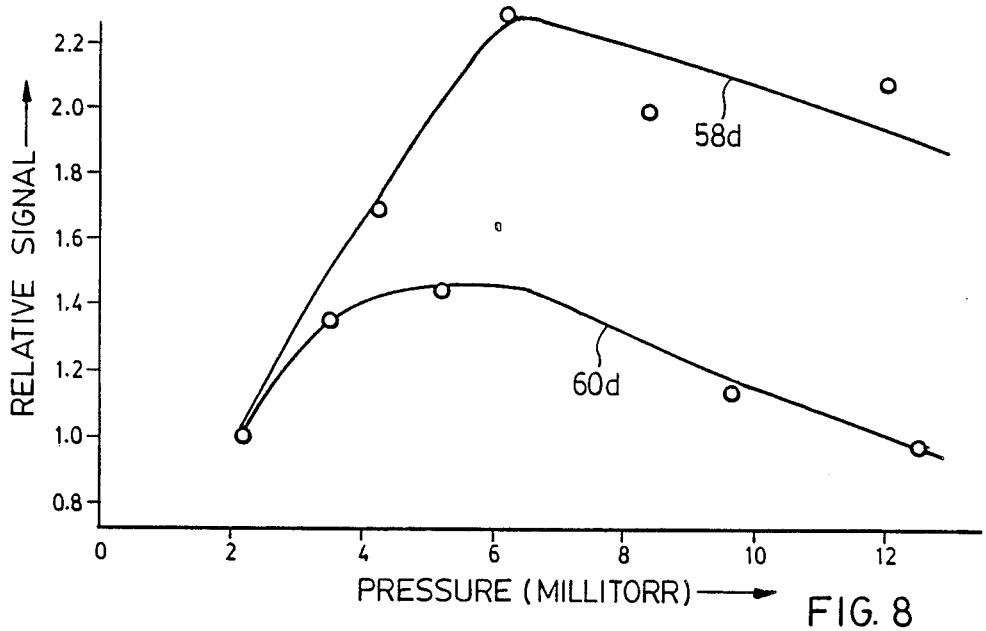
FIG. 8 is a plot similar to that of FIG. 7 but under different voltage conditions.

FIGS. 7 and 8 correspond to FIGS. 5 and 6 but are for m/e 391 rather than for m/e 196. Here curves **58*c*, 60*c* are for 1 mm and 2.5 mm orifices 26 respectively for a 10 volts DC difference voltage, and curves 58*d*, 60*d* are for 1 mm and 2.5 mm orifices 26** for a 15 volts DC difference voltage. In all cases the ion signal intensities on the vertical axis were normalized to 1.0 at a pressure of 2.4 millitorr and do not represent absolute values.

It is believed that the greater enhancement with a 1 mm orifice than with a 2.5 mm orifice indicates that the ions are being forced toward the center line of the system and that the mechanism which is causing the enhancement is a kind of collisional focussing or damping effect which concentrates the ion flux closer to the central axis. It will also be noted that a greater enhancement occurred for high masses than for low masses. It can be seen from FIG. 3 that the gain in signal achieved by operating at 6 millitorr instead of 2.4 millitorr increased approximately linearly with mass. This is desirable, since normally the analyzing quadrupole 40 has reduced transmission for high mass to charge ratio ions as compared with low mass to charge ratio ions, and therefore it is desirable to increase the number of high mass to charge ratio ions reaching quadrupole 40.

In a separate experiment, the absolute values of the total ion currents, i.e. the sum of all ions, in the operation of the FIG. 1 apparatus were as follows (and were measured as follows). Firstly, the mass spectrometer 40 was back biased to a voltage higher than that on the orifice plate 28 (e.g. to plus 55 volts DC), and the total ion current to the separator plate 36 was measured. Under these conditions the separator plate 36 was found to collect essentially all of the current entering the chamber 30 through the orifice 20. Then the back bias on the quadrupole 40 was lowered to zero (or at least to a voltage not higher than that on the AC-only rods 32, so that the ions would not have to travel up a voltage gradient) and the current on the separator plate 36 was again measured. This current was found to be now much lower, and the assumption was that the difference in current travelled through the interchamber orifice 34 to the analyzing quadrupole 40.

When the interchamber orifice 34 was 2.5 mm in diameter, and when the analyzing quadrupole 40 was back biased, the current collected on the separator plate 36 was 100 picoamps. When the back bias on the analyzing quadrupole 40 was removed and with the pressure in chamber 30 about 6 millitorr, such current fell to 10 picoamps. This indicated that 90 percent of the ions were transmitted through the small interchamber orifice 34 to the analyzing quadrupole 40. This percentage is unexpectedly high in view of the small size of orifice 34.

When the interchamber aperture 34 was 1 mm in diameter and quadrupole 40 was back biased, and with a pressure of 2.5 millitorr in chamber 30, the ion current collected on the separator plate 36 was 108 picoamps. When the back bias on the analyzing quadrupole 40 was removed, such current dropped to 93 picoamps, indicating that 15 picoamps had gone through the 1 mm orifice 26 (less than 15% transmission).

Then when the pressure in chamber 30 was increased to 6 millitorr, the ion current collected on the separator plate 36 was 75 picoamps with the analyzing quad 40 back biased, and fell to 54 picoamps when the back bias was removed, indicating that a current of 21 picoamps was now passing through the orifice 36. This was an enhancement of about 40 percent.

Since it was possible to transmit about 90 percent of the ion current through a 2.5 mm orifice 36 and only about 20 percent through a 1 mm orifice 36, it is of course preferable from an ion transmission viewpoint to use the larger orifice. However the experiment, showing that a greater relative enhancement occurred with increased pressure when the smaller orifice 36 was used, indicated that collisional effects were forcing the ions toward the center line and that the effect was not spurious. It also indicated that there would be little to be gained by increasing the size of orifice 36 above 2.5 mm diameter at least in the equipment used, since 2.5 mm was sufficient to pass 90 percent of the ions.

Figure 9:
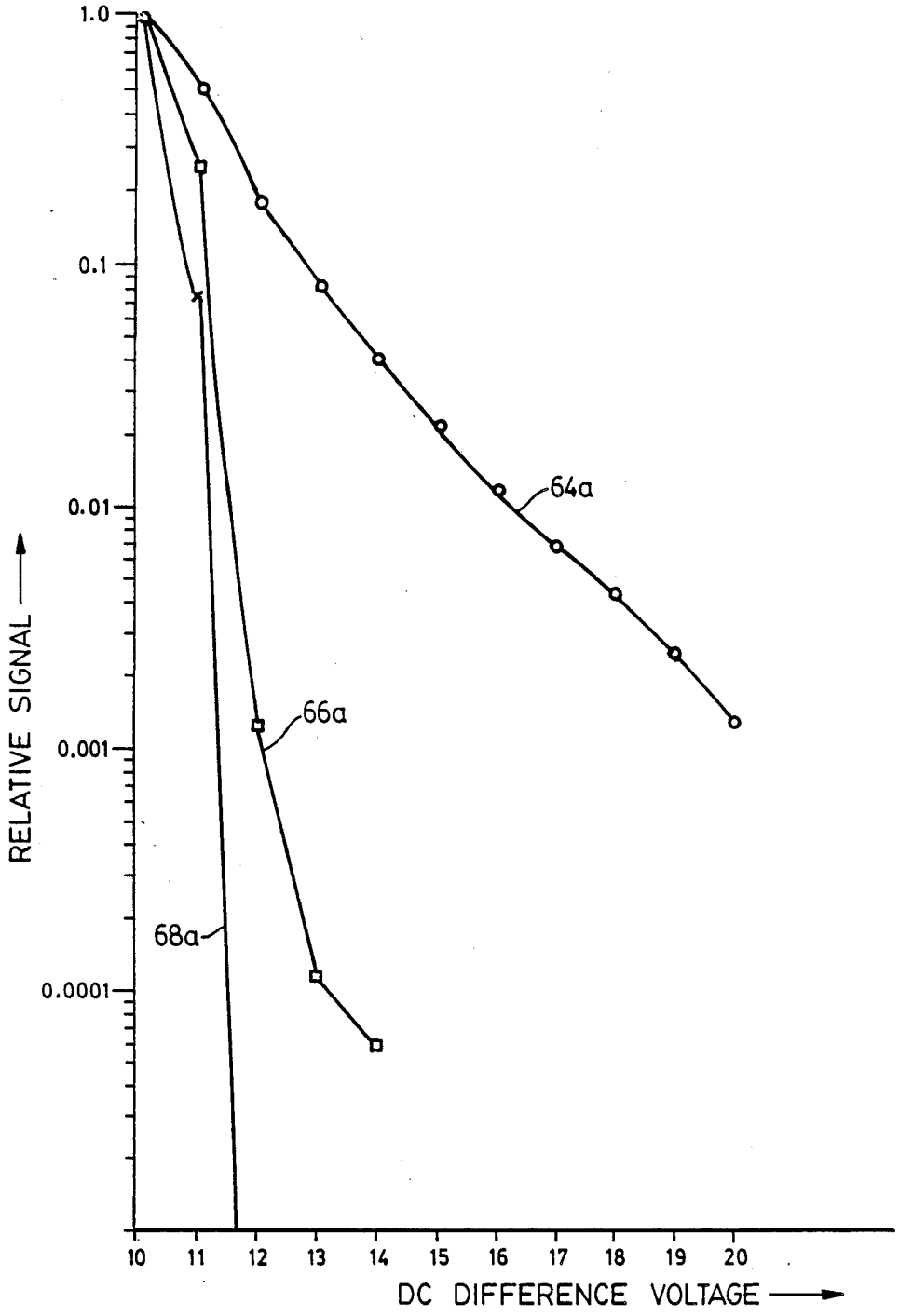
FIG. 9 is a plot of stopping curves for mass 196 under three different pressure conditions.
Figure 10:
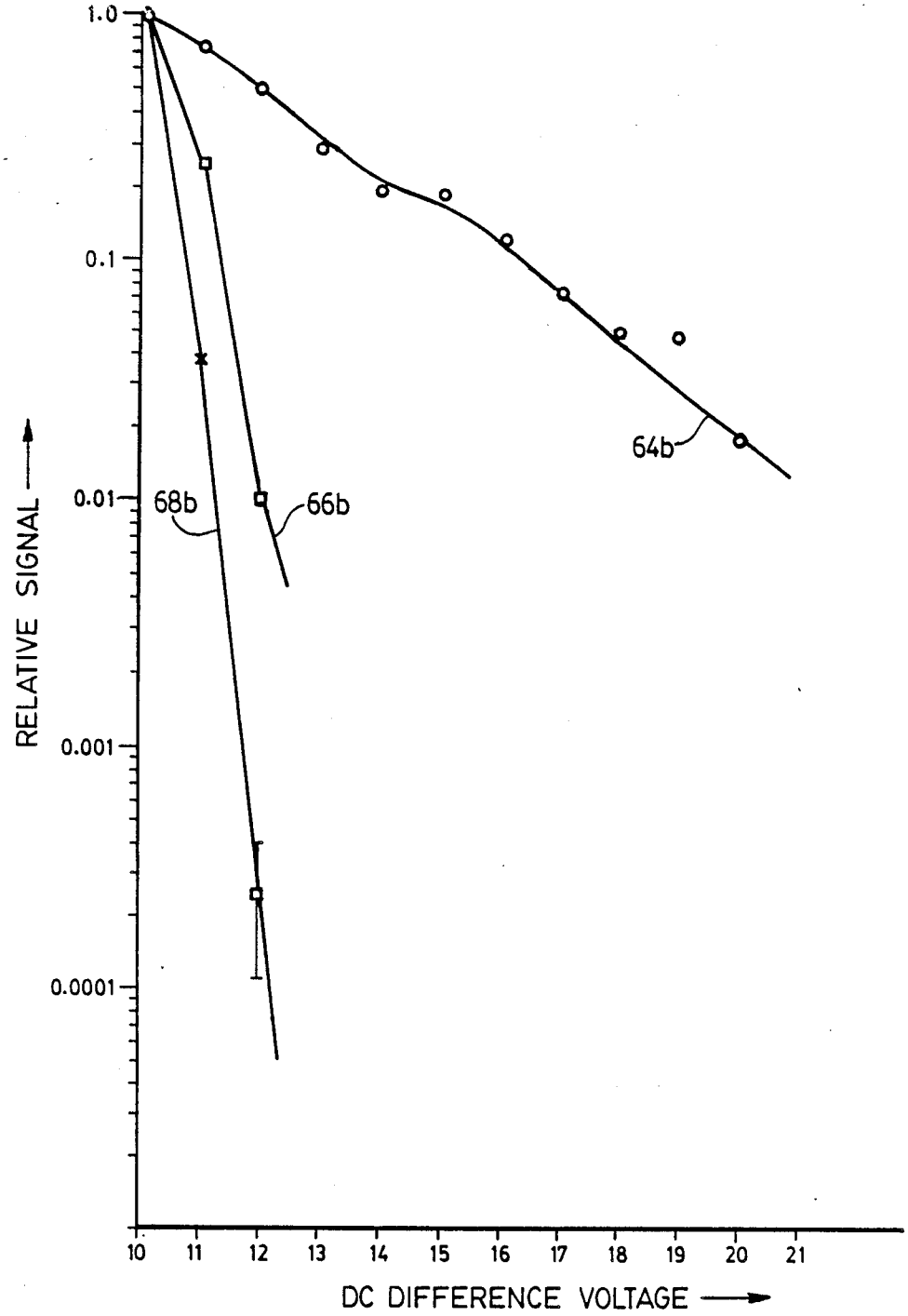
FIG. 10 is a plot similar to that of FIG. 9 but for mass 391.
Figure 11:
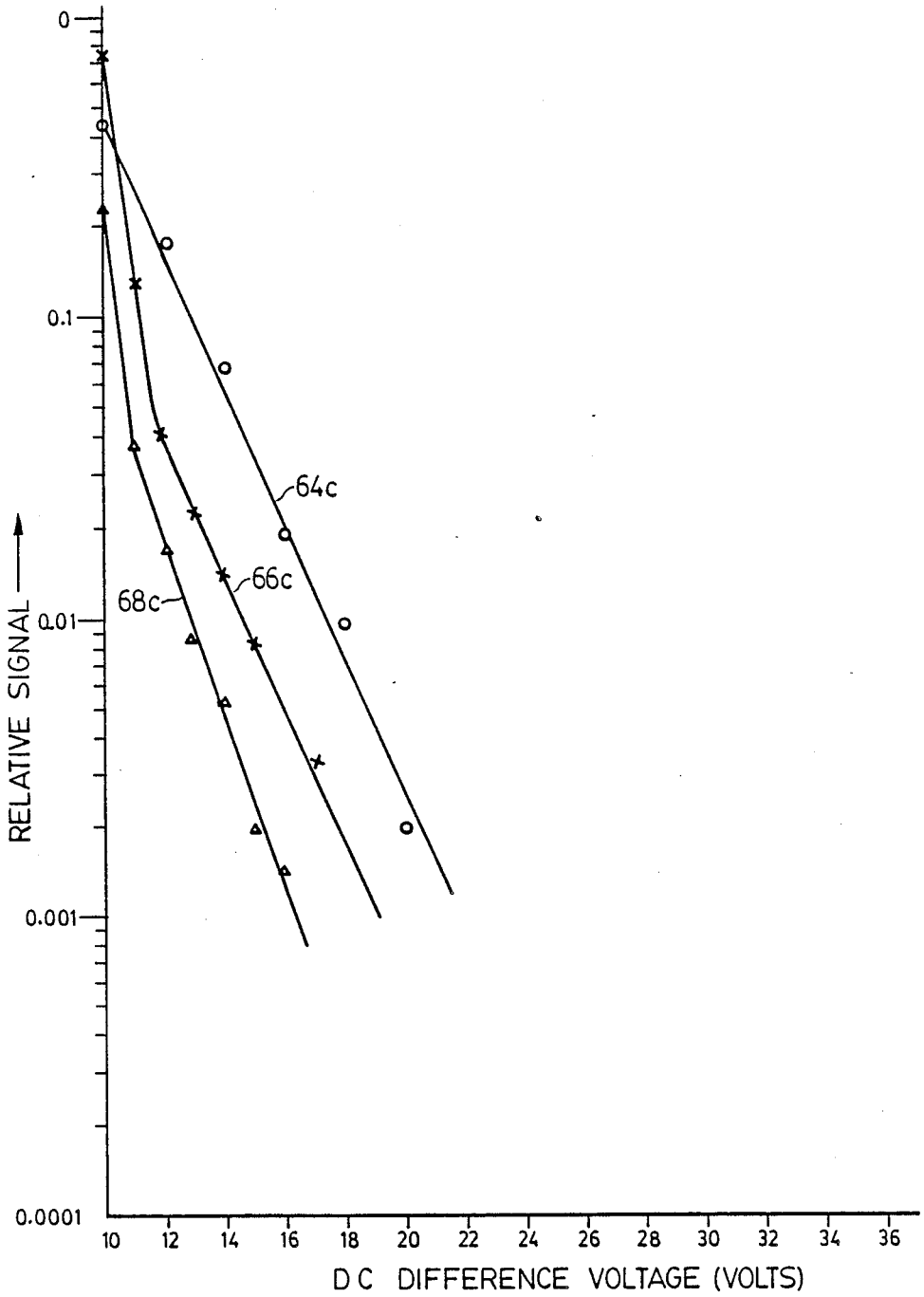
FIG. 11 is a plot similar to that of FIG. 9 but for mass 832.

Reference is next made to FIGS. 9 to 11, which show "stopping curves" for ions with mass to charge ratios 196, 391 and 832 respectively. Stopping curves are produced by increasing the rod offset voltage (i.e. the DC bias voltage applied to all the rods) on the analyzing quadrupole 40 and observing how the signal detected by detector 48 decreases as the voltage increases. The decrease in ion signal with increasing rod offset voltage is a measure of what "stops" before it reaches the analyzing quadrupole 40, i.e. it is a measure of the kinetic energy of the ions entering the analyzing quadrupole 40. In all cases the DC difference voltage between the AC-only rods 32 and the orifice plate 28 was 10 volts. Therefore the back bias DC voltage on the analyzing quadrupole 40 was started at 10 volts, since it was not expected that there would be any ions with a lower energy than 10 electron volts above ground potential. In the stopping curves of FIGS. 9 to 11, the back bias voltage on the analyzing quadrupole 40 is plotted in a linear scale on the horizontal axis, and the relative ion signal is plotted in a logarithmic scale on the vertical axis.

In FIG. 9, which is for m/e 196, curve **64*a* is 66*a* resulted when the pressure was increased to 5.9 millitorr, and curve 68*a* resulted when the pressure was increased to 9.8 millitorr. In all cases, the stopping curves show that the energy spread of most of the ions entering the analyzing quadrupole 40** was low, a commercial advantage in that it enhances the resolving power to cost ratio of the mass analyzer.

Specifically, when the pressure in chamber 30 was 2.4 millitorr, 99 percent of the ions had an energy spread as shown in FIG. 9 of only about 6 electron volts. In addition, the energies of such 99 percent ranged between 10 and about 16 electron volts, i.e. the energies were quite low.

When the pressure in chamber 30 was increased to 5.9 millitorr, 99.9 percent of the ions had an energy spread within about 2 electron volts and an energy of less than 12 electron volts. When the pressure was increased to 9.8 millitorr, the energy spread and maximum energy were reduced even further.

Similar results were obtained for masses 391 (FIG. 10) and 832 (FIG. 11), except that the energy spreads and maximum energies were higher for the higher mass to charge ratios. In FIG. 10, curve **64*b*', 66*b*, 68*b* are the stopping curves at 2.4 millitorr, 5.9 millitorr, and 9.8 millitorr respectively. In FIG. 11, curves 64*c*, 66*c*, 68*c*** are the stopping curves at 2.5 millitorr, 5.6 millitorr and 8.6 millitorr respectively.

The enhancement curves of FIGS. 5 to 8, and the stopping curves of FIGS. 9 to 11, indicated that the collisional effects were removing both axial and radial velocities from the ions, causing resultant velocity vectors which permitted the ions to travel through the interchamber orifice 34. If the radial velocities of the ions were higher, the ions would be less likely to travel through the orifice 34. If the axial velocities of the ions were higher, this would not affect their passage through the orifice 34, but such higher energy ions with a higher energy spread are more difficult to resolve.

Figure 12:
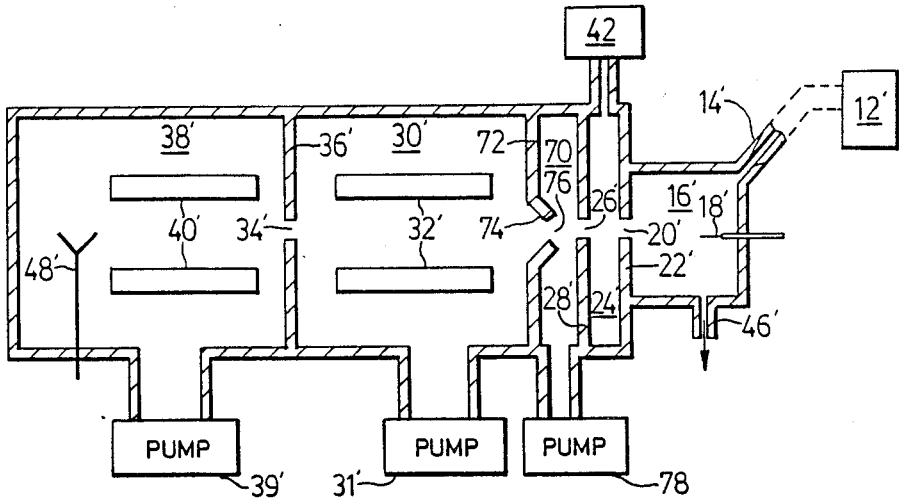
FIG. 12 is a diagrammatic view of a modification of the mass analyzer system of FIG. 1.

Reference is next made to FIG. 12, which shows a modification of the FIG. 1 apparatus and in which primed reference numerals indicate corresponding parts. The difference from FIG. 1 is that an intermediate chamber 70 has been added between the orifice plate 28 and the AC-only rods 32. The chamber 70 is defined by a skimmer plate 72 having therein a conical-shaped skimmer 74 pointing toward the orifice 26. The skimmer 74 contains a skimmer orifice 76. In section as shown, the AC-only rods 32' form the base of the triangle defined by extending the sides of the skimmer 74. Gas is pumped from the chamber 70 by a small rotary pump 78. (In another version tested, the AC-only rods 32', which were quite close together, extended into the cone of the skimmer 74, and it was found that this produced improved sensitivity.)

In the FIG. 12 version, orifice 26' was nearly three times as large as in the FIG. 1 version (0.254 mm instead of 0.089 mm). The skimmer orifice 76 was 0.75 mm in diameter, and the interchamber orifice 34' was (as in a previously mentioned experiment) 2.5 mm in diameter. Again rod set 32' was 15 cm long. With this arrangement, the pressure in chamber 70 was typically set at between about 0.4 and about 10 torr. A pressure of about 2 torr gives good results and does not require a large pump.

The purpose of the FIG. 12 arrangement was to adjust the voltages to draw more ions through than previously. The fixed DC voltages used in the FIGS. 1 and 12 arrangements were typically set as follows:

| | FIG. 1 Arrangement (volts) | FIG. 12 Arrangement (volts) |
|---|---|---|
| Gas curtain plate 22 | 600 | 1000 |
| Orifice plate 28 | 25 | 150 to 200 |
| Skimmer plate 72 | | 90 |
| AC-only rods 32 | 15 | 80 to 85 |
| Separator plate 36 | 0 | 0 to 60 |
| Analyzing rods 40 (offset voltage) | 10 | 70 to 80 |

It was found that with the physical arrangement shown in FIG. 12, the ion to gas ratio entering the AC-only rods 32' increased by a factor of about two to four, as compared with the FIG. 1 arrangement, when appropriate pressures (typically 5 to 8 millitorr) were used in chamber 30' and when an appropriate DC difference voltage (preferably about 1 to 15 volts) existed between skimmer plate 72 and AC-only rods 32'.

In an experiment using the FIG. 12 apparatus, a comparison of count rates (i.e. ion current) was obtained for various substances using first a pressure of 0.5 millitorr in chamber 30', and then using a pressure of 5 millitorr (i.e. a pressure 10 times higher). Table I below shows the count rate comparison for the various substances used:

TABLE I

| Substance | Mass | Mass to Charge Ratio | Ratio of Ion Signal at 5 Millitorr to Ion Signal at .5 Millitorr |
|---|---|---|---|
| DMMPA* | 196 | 196 | 7.1 |
| PPG** | 906 | 906 | 8.6 |
| Mellitin | 2845 | 712 | 15 |
| Insulin | 5740 | 1144 | 40 |
| Myoglobin | 16950 | 893 | 79 |

*Dimethylmorpholinophosphoramidate
**Polypropylene glycol
(Mellitin was charged four times; Insulin was charged five times, and Myoglobin was charged 19 times.)

It will be noted that the enhancement of the ion signal increases substantially at higher molecular weights. The reasons for this are not understood, but the effect is desirable since higher molecular weight ions are normally more difficult to detect. It is noted that Table I shows the ratio of ion count rates obtained for the substances tested and not simply the ratio of ion currents into the analyzing quadrupole 40.

Table I is in a sense unfair, since the measurements at high pressure (5 millitorr) were carried out with the difference voltage between the AC-only rods 32 and the skimmer plate 72 optimized for the high pressure (i.e. adjusted to obtain the maximum counts at such pressure). However the difference voltage was left unchanged and no similar optimization was carried out when the pressure was changed to a low pressure (0.5 millitorr). Table II below therefore shows the results obtained for the apparatus used after optimizing the difference voltage at both high and low pressures (5 millitorr and 0.5 millitorr).

TABLE II

| Substance | Mass | Mass to Charge Ratio | Ratio of Ion Signal at 5 Millitorr to Ion Signal at .5 Millitorr |
|---|---|---|---|
| DMMPA | 196 | 196 | 3.4 |
| PPG | 906 | 906 | 6.9 |
| Myoglobin | 16950 | 893 | 10.9 |

The enhancement effect in Table II is substantially less than that shown in Table I, but the enhancement still increases for high masses and is approximately an order of magnitude for myoglobin. Further, the enhancement appears to depend on mass and not on mass to charge ratio.

It is noted that the AC-only rods 32 and chamber 30 essentially function as an ion-gas separator, guiding ions through the interchamber orifice 34 while transmitting as little gas as possible. Therefore one would not normally increase the pressure in chamber 30, since this produces an increased gas flow through orifice 34 as well as being expected to attenuate the ion signal as shown in FIG. 2. However it will be seen that when the pressure in chamber 30 is increased, the ion signal through orifice 34 is not lost but in fact is enhanced. Even though the gas load has increased, it will be seen that for heavy mass ions the ion to gas ratio through orifice 34 remains the same or is slightly improved. For low mass ions, the ion to gas ratio through orifice 34 decreases, but the increased pump size needed for chamber 38 is offset by the decreased pump size needed for chamber 30. At the same time the ion signal through orifice 34 is increased and the ion energy spread is reduced.

In addition it is found that the increase in pressure in chamber 30 or 30'reduces an effect known in optics known as focussing aberration. To explain this, reference is next made to FIG. 13, which shows an enlarged view of the AC-only rods 32', together with the interchamber orifice 34'.

When a vacuum is present in chamber 30', different mass to charge ratio ions moving through the AC-only rods 32' will have different trajectories. For purposes of illustration, one trajectory envelope 80 is shown for a first type of ion, and a second trajectory envelope 82 is shown for a second type of ion. Since the envelope 80 is smaller than envelope 82 at the interchamber orifice 34, more of the first type of ion will pass through such orifice and the result will be that the mass spectrum will show a larger quantity of ions having trajectory envelope 80 than those which have trajectory envelope 82. This is indicated in the mass spectrum of FIG. 14, where the quantities of ions having trajectory envelopes 80, 82 are indicated at 84, 86 respectively. If the quantities of both types of ions were in fact equal, this distortion, which in effect is caused by the different wavelengths and phases of the trajectories of different ions travelling through the AC-only rod set, is referred to as focussing aberration.

It is found that when the AC-only rod set 32' is operated at a high pressure (e.g. 5 millitorr), with a relatively low DC difference voltage between the skimmer plate 72 and the AC-only rod set 32' (e.g. 5 volts), then not only are higher ion signals received, but in addition focussing aberration is reduced.

Figure 15:
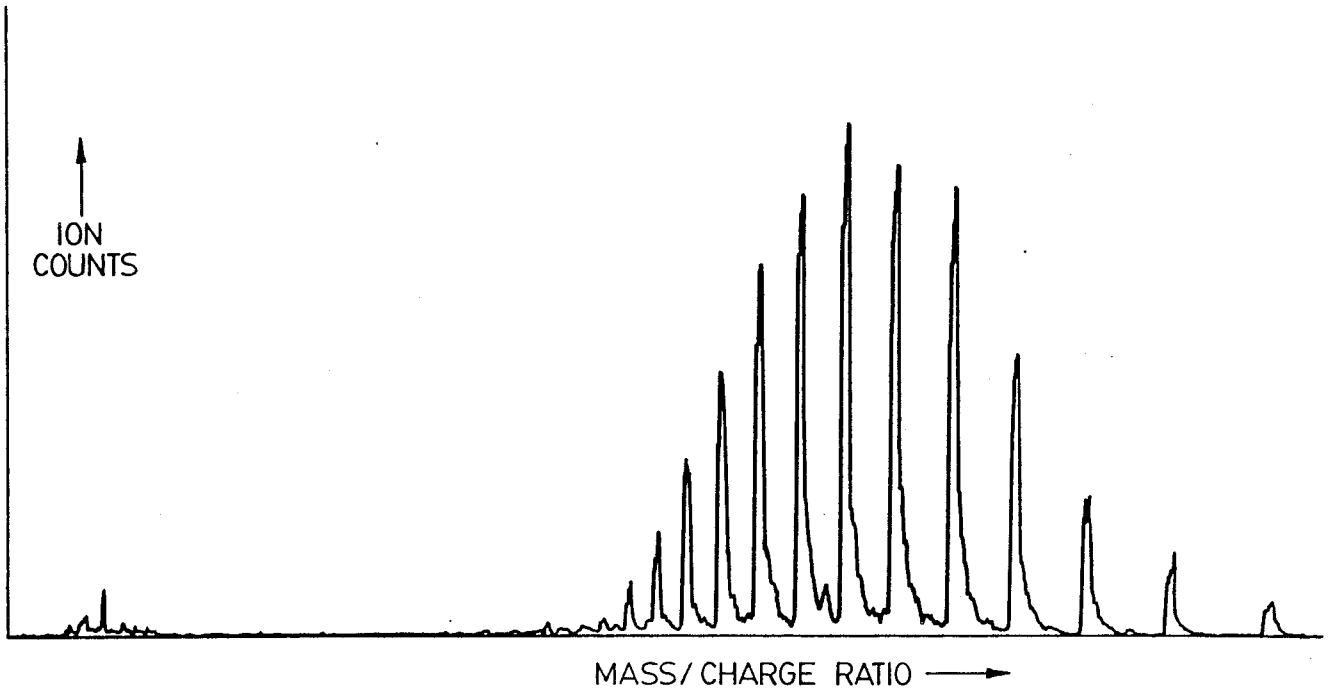
FIG. 15 is a mass spectrum for a sample substance at high pressure and with a low DC difference voltage.
Figure 16:
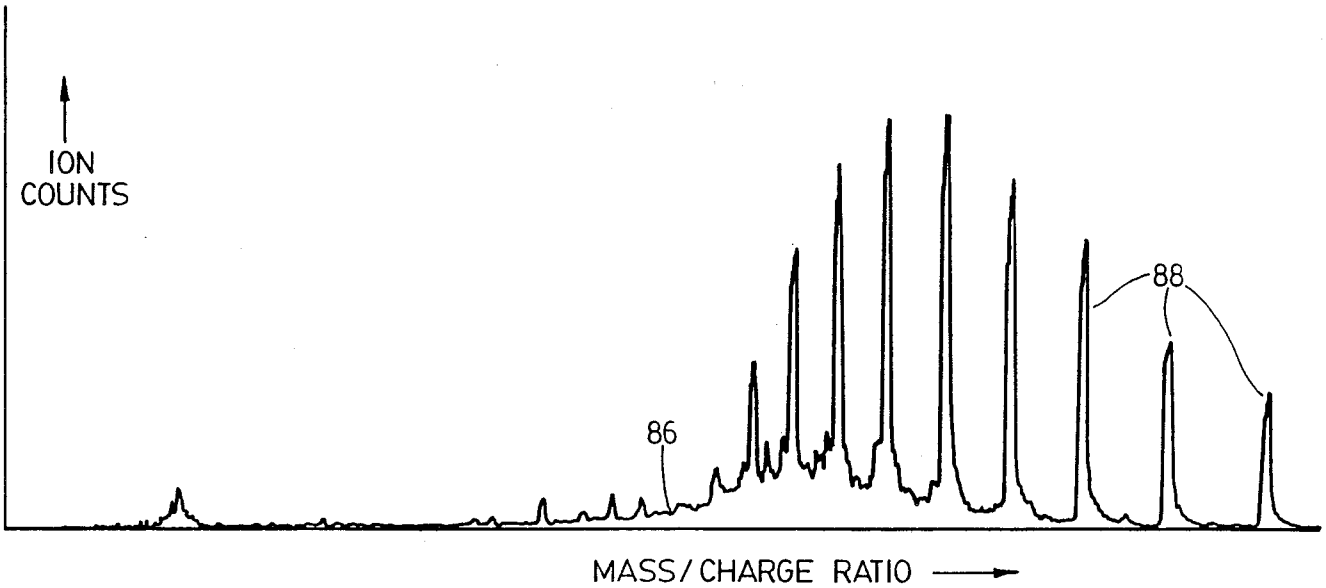
FIG. 16 is a mass spectrum for the sample substance of FIG. 15 at the same pressure but with a higher DC difference voltage.
Figure 17:
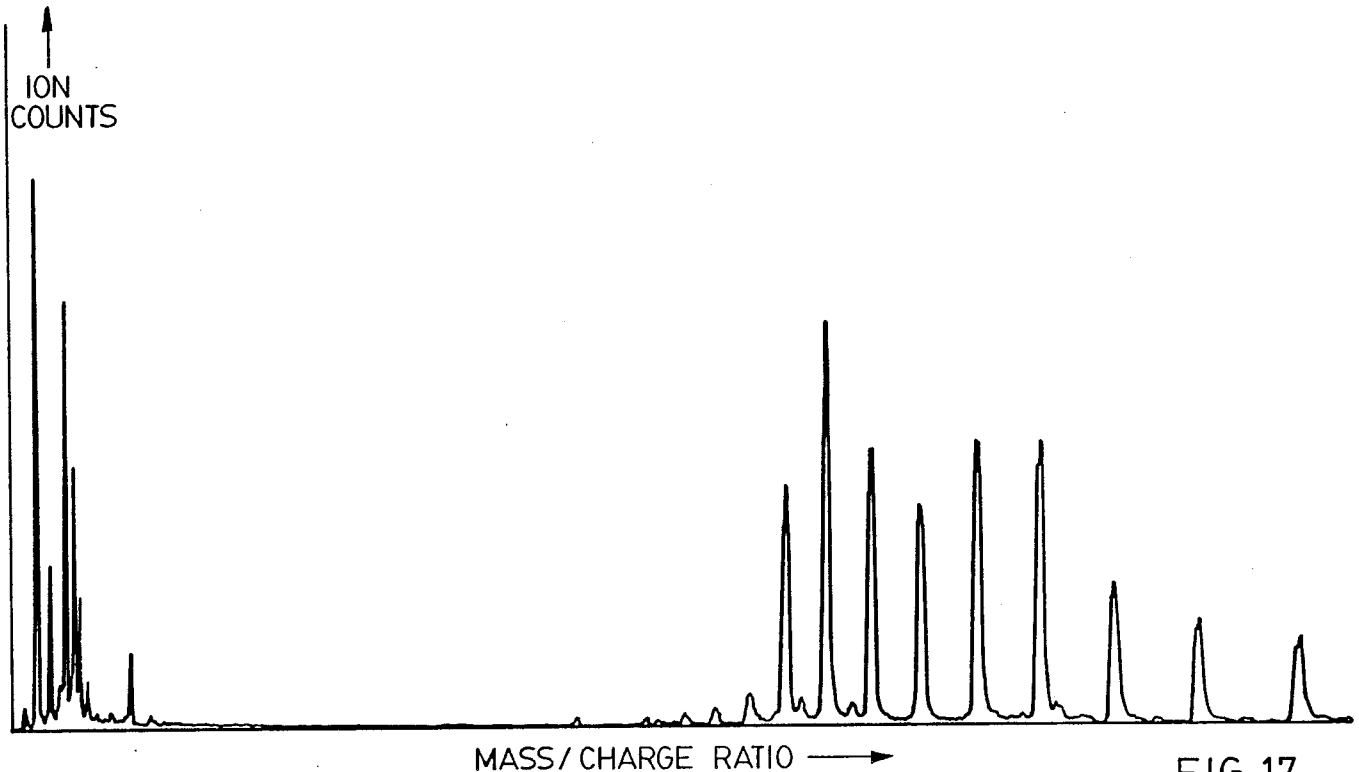
FIG. 17 is a mass spectrum for the substance of FIG. 15 at lower pressure and with a high DC difference voltage.
Figure 18:
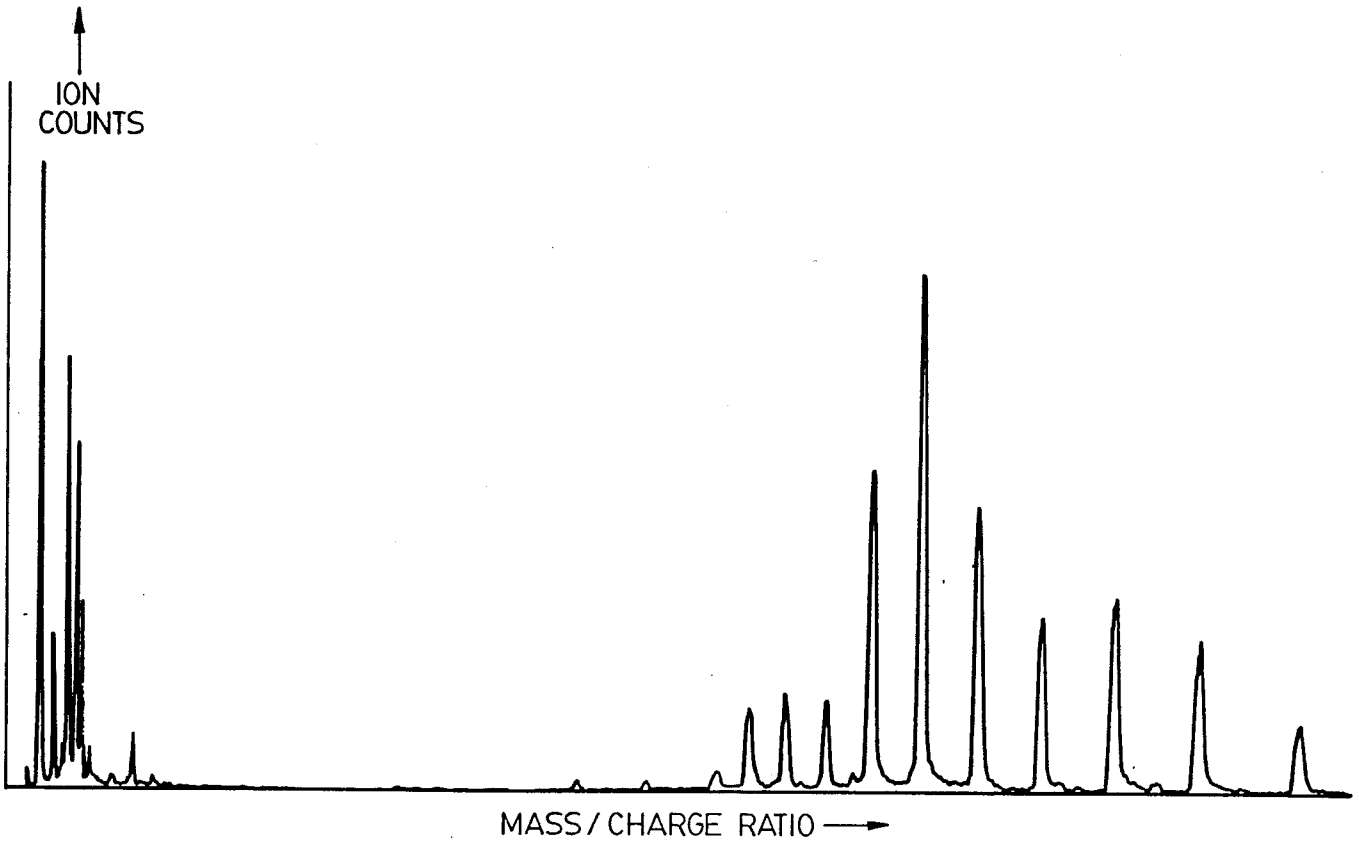
FIG. 18 is a mass spectrum for the substance of FIG. 15 but with a still higher DC difference voltage.

In the experiment which produced this result, the substance myoglobin was multiply charged and run through the FIG. 12 apparatus. Since only a single kind of molecule was used, and since more charges would be applied to some of those molecules than to others, one would normally expect a relatively smooth distribution of peaks in the mass spectrum (which shows mass to charge ratio). In FIGS. 15 to 18, the following test conditions were used:

| | (1) Pressure in Chamber 30' | (2) DC Voltage on Orifice Plate 28' | (3) DC Voltage on Skimmer Plate 72 | (4) DC Voltage on AC-Only Rods 32' | (5) Difference Voltage Between (3) and (4) |
|---|---|---|---|---|---|
| FIG. 15 | 5.6 mt. | 150 v. | 95 v. | 90 v. | 5 v. |
| FIG. 16 | 5.6 mt. | 150 v. | 95 v. | 80 v. | 15 v. |
| FIG. 17 | .5 mt. | 160 v. | 135 v. | 50 v. | 85 v. |
| FIG. 18 | .5 mt. | 160 v. | 135 v. | 40 v. | 95 v. |

mt = millitorr

In FIGS. 15 to 18, mass to charge ratio is plotted on the horizontal axis and ion counts are plotted on the vertical axis. In FIGS. 15 and 16 the vertical scale is $1.28\times10^6$ counts per second full scale, and in FIGS. 17 and 18 the vertical scale is $3.2\times10^5$ counts per second full scale (since higher count rates are obtained at the higher pressure). In FIGS. 15 to 18 the mass to charge ratio on the horizontal axis is 0 at the left hand side up to 1500 full scale.

It will be seen that in FIG. 15 the distribution of peaks is relatively smooth, as expected. In FIG. 16 the distribution is also relatively smooth and is not too different in shape from that of FIG. 15. There is a larger continuum of counts at low masses (as shown at 86), probably due to collision induced dissociation of the ions into ions of varied mass to charge ratio due to the higher energies. The high mass to charge ratio are also accentuated (as shown at 88), probably because some ions lost some of their charges due to more energetic collisions and hence had higher mass to charge ratios. However overall, the distortion was relatively moderate, although the overall amplitude of the response was somewhat reduced.

At low pressures and with the difference voltage first set at 85 volts (FIG. 17) and then 95 volts (FIG. 18), more signal was obtained but much more distortion occurred. In addition the distribution of peaks was no longer a smooth curve. The ion counts for each of the peaks did not vary at all proportionately as the difference voltage was changed, even though the variation (10 volts) was a much smaller percentage of the original value than was the case in FIGS. 15 and 16. Thus, at low pressures, if the difference voltage was adjusted to optimize the response for one ion, the result was severe distortion of the responses for other ions. At higher pressures, the distortion or focussing aberration was greatly reduced.

In the result, the higher gas pressures and relatively low DC difference voltages used as described have been found to produce the following advantages:

1. Substantially higher ion signal.
2. A smaller pump on the AC-only rod stage (since a higher pressure can be used).
3. Less cost and greater portability (since smaller pumps are much lighter and cheaper).
4. Less focussing aberration.
5. Better sensitivity at high masses (and high masses are often the most difficult to detect and yet of growing importance in some applications of mass spectrometry).

The inventors have calculated that when chamber 30' is operated at 6 millitorr, and chamber 38' at 0.02 millitorr, then pumps 31, 39 and 78 can be relatively small, so the resultant instrument will then be of relatively small bench top size, and yet it can have a sensitivity which is equal to or greater than that of much larger and more costly instruments at the present time.

In addition, if the voltage between orifice plate 28' and skimmer plate 72 is sufficient (e.g. 50 to 200 volts), declustering and even collision induced dissociation can be effected for the incoming ions. Because the pressure between these two plates is relatively high, the energy spread of the resultant ions entering the AC-only rods remains relatively low.

It is also noted that as mentioned, that the DC difference voltage between the AC only rods 32, 32' and the plate through which the ions enter the vacuum chamber 30' (either orifice plate 28 in FIG. 1 or skimmer plate 72 in FIG. 12) should normally be low at the high pressures used. If the normal difference voltage of 85 to 95 volts DC is used, the signal enhancement effects disappeared, and in fact the ion signal transmitted to the analyzing quadrupole 40 was drastically reduced. While the reasons for this are not entirely understood, it appears that a large number of relatively low energy collisions are effective in damping both the radial and axial velocities of the ions and in forcing the ions by collisional damping closer to the centre line of the AC-only rod set 32. It appears that more energetic collisions, which occur when the offset voltage is higher, do not have a similar effect and in fact for some reason reduce the ion signal. Further, a high ion energy can lead to collision induced dissociation, resulting in further ion loss. A difference voltage of between 40 and 100 volts between the AC-only rods 32 or 32', and the wall 28 or skimmer 74 tended to shut off the ion signal at pressures of 2.5 millitorr and higher in chamber 30, 30'. However it may be that using such high difference voltage (e.g of between 40 and 100 volts DC), but also using additional focussing lenses, may still produce signal enhancement effects.

The experiments which have been conducted show that a preferred range for the difference voltage between the AC-only rods 32, 32', the wall 28 or skimmer 74 is between about 1 and 30 volts DC. A range of between about 1 and 15 volts DC produces better results, while in the apparatus used, the best results occurred at between about 5 and 10 volts.

It is noted that although in the system described, the only voltage applied between the rods 32 is an AC voltage, it may be desired in some cases to place a small DC voltage between the rods 32. In that case the rods 32 would act to some extent as a mass filter. However the voltage between rods 32 is preferably essentially an AC-only voltage.

It is also noted that the number of collisions which an ion has while travelling through the AC-only rods 32 is determined by the length of the rods multiplied by the pressure between the rods. To a first approximation, it would be possible to double the pressure and then halve the length of the rods, and still have the same number of collisions. However the AC-only rod set 32 cannot be too short, since a sufficient number of RF cycles is needed for the AC-only rod set 32 to focus the ions passing therethrough. Of course if the ions are slowed down by collisions during their passage through the rod set 32, then they will experience more RF cycles and will be better focussed. A higher number of cycles could be obtained by increasing the frequency of the AC voltage applied to the rod set 32, but this would require a higher voltage (to achieve the same "q") and hence more expensive electronics and more likelihood of electrical breakdown. In any event, by increasing the pressure and thereby reducing the length of the rod set 32, the instrument again becomes smaller, more portable and less expensive. In the equipment shown in FIGS. 1 and 2, the AC-only rods 32' were 15 cm long. At a pressure of 5.0 millitorr, it can be calculated that an ion passing through these rods would experience at least about 15 collisions on average. The significant parameter, then, is the product of the pressure in chamber 30, 30' times the length of the AC-only rods 32, 32'. This product (which often is called the target thickness) will be called the PL product and is expressed in torr-cm.

For the apparatus used, with rods 32, 32' 15 cm long, it was found that pressures above 1.5 millitorr (PL product= $2.25\times10^{-2}$ torr cm) produced signal enhancement. A pressure at or above 2.4 millitorr (PL product= $3.6\times10^{-2}$ torr cm), or even better, a pressure above 5 millitorr (PL product= $7.5\times10^{-2}$ torr cm) produced better results. Good results occurred over a pressure range of 4 to 10 millitorr (PL product between $6\times10^{-2}$ torr cm), and even a pressure range of between 2 and 20 millitorr (PL product between $3\times10^{-2}$ and $30\times10^{-2}$ torr cm) produced reasonable enhancement, with the other benefits mentioned. A pressure of about 6 to 8 millitorr (PL product= $9\times10^{-2}$ to $12\times10^{-2}$ torr cm) produced approximately peak enhancement.

Figure 19:
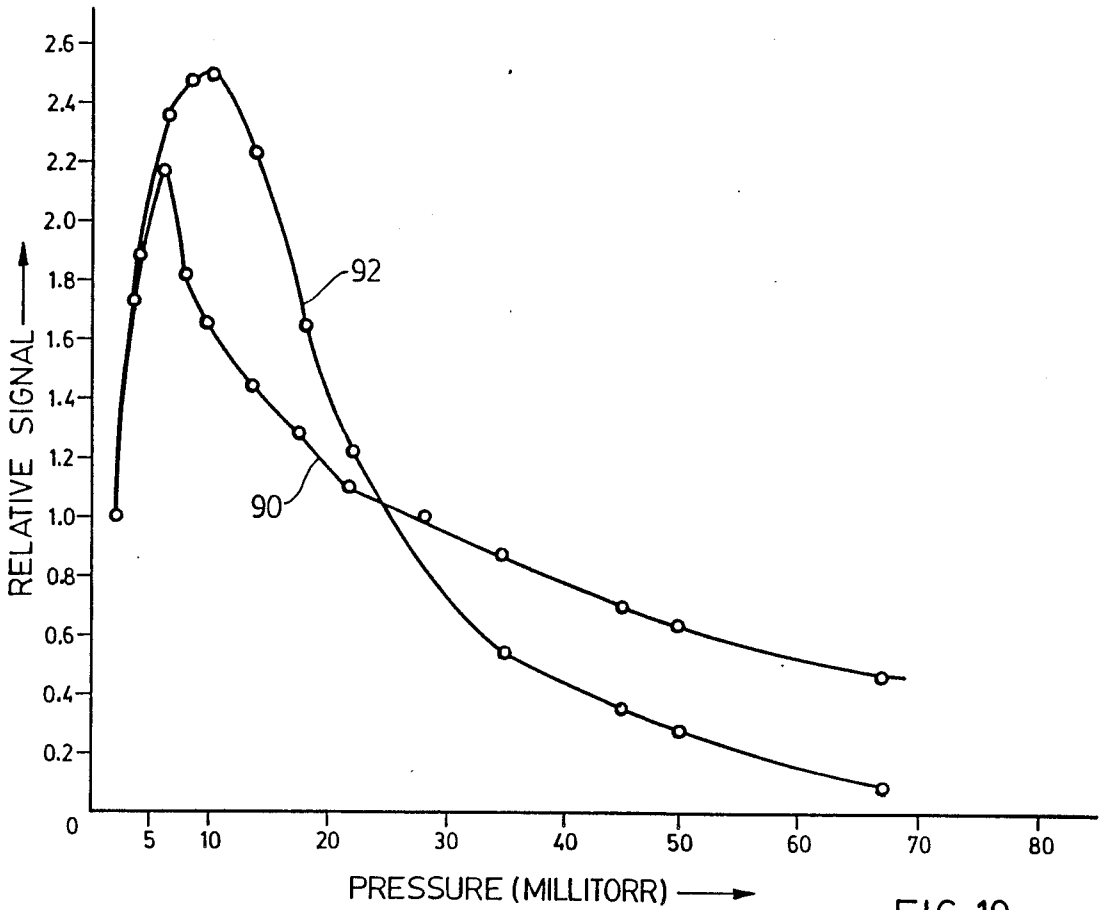
FIG. 19 is another graph showing relative ion signal versus pressure for an instrument according to the instrument.

While an upper limit for the pressure in chamber 30 has not been determined, pressures of up to 70 millitorr (PL product= $105\times10^{-2}$ torr cm) have been tested without electrical breakdown. The results were as shown by curves 90 (for m/e 196) and 92 (for m/e 391) in FIG. 19. As there shown, enhancement of the ion signal through orifice 34' occurred up to between 25 and 30 millitorr. Above these pressures, the signal was reduced as compared with that at 2.4 millitorr, but a significant portion of the signal remained (it did not disappear as had occurred with a high difference voltage). In addition the energy spread was very low, and at these high pressures a rotary pump (which is small and relatively inexpensive) can be used on chamber 30, 30' (although a larger pump is now needed for chamber 38, 38'). It is noted that for the FIG. 1 experiment, the mass 391 substance was a dimer of the mass 196 substance, so the higher attenuation for mass 396 may have been due simply to dissociation of the ions of this mass.

It is expected that pressures of up to between 150 and 200 millitorr can be used if desired, and such high pressures would produce an extremely low energy spread in the ions entering the analyzing quadrupole 40'. However they would necessitate a relatively larger pump to evacuate chamber 38' adequately so that the analyzing quadrupole 40' can function.

In all cases in which the relatively high pressures described are used, the AC-only rods should occupy substantially all or at least a substantial portion of the length of chamber 30, 30'. If they do not, scattering and losses will occur in the portion of these chambers in which the ions are not guided by the AC-only rods.

The FIG. 12 apparatus can be modified if desired by substituting a small tube for the orifice 34'. The tube will have a length to diameter ratio of about 2 to 3 and can extend on either side of plate 36', or on both sides. The tube has a lower conductance for gas than does orifice 34'but has about the same conductance for ions as does orifice 34'. Therefore, if the internal diameter of the tube is the same as that of orifice 34', a smaller pump 39' can be used. Alternatively the internal diameter of the tube can be made larger than that of orifice 34'to use about the same size pump 39', but with the larger opening more ions are transmitted into rods 40', increasing the sensitivity of the instrument.

We claim:

1. A mass spectrometer system comprising:

(a) first and second vacuum chambers separated by a wall, said first vacuum chamber having an inlet orifice therein, (b) means for generating ions of a trace substance to be analyzed and for directing said ions through said inlet orifice into said first vacuum chamber, (c) a first rod set in said first vacuum chamber extending along at least a substantial portion of the length of said first vacuum chamber, and a second rod set in said second vacuum chamber, each rod set comprising a plurality of elongated parallel rod means spaced laterally apart a short distance from each other to define an elongated space therebetween extending longitudinally through such rod set, said elongated spaces of said first and second rod sets being first and second spaces respectively, said first rod set being located end to end with said second rod set so that said first and second spaces are aligned, (d) an interchamber orifice located in said wall and aligned with said first and second spaces so that ions may travel through said inlet orifice, through said first space, through said interchamber orifice, and through said second space, (e) means for applying essentially an AC-only voltage between the rod means of said first rod set so that said first rod set may guide ions through said first space, (f) means for applying both AC and DC voltages between the rod means of said second rod set so that said second rod set may act as a mass filter for said ions, (g) means for flowing gas through said inlet orifice into said first space, (h) means for pumping said gas from each of said chambers, (i) the pressure in said second chamber being a very low pressure for operation of said second rod set as a mass filter, (j) the product of the pressure in said first chamber times the length of said first rod set being equal to or greater than $2.25\times10^{-2}$ torr cm but the pressure in said first chamber being below that pressure at which an electrical breakdown will occur between the rod means of said first rod set, (k) and means for maintaining the kinetic energies of ions moving from said inlet orifice to said first rod set at a relatively low level, whereby to provide improved transmission of ions through said interchamber orifice.

2. Apparatus according to claim 1 wherein said product is at or above $3.6\times10^{-2}$ torr cm.

3. Apparatus according to claim 1 wherein said product is at or above $7.5\times10^{-2}$ torr cm.

4. Apparatus according to claim 1 wherein said product is not greater than about $105\times10^{-2}$ torr cm.

5. Apparatus according to claim 1 wherein said product is between $3\times10^{-2}$ and $30\times10^{-2}$ torr cm.

6. Apparatus according to claim 1 wherein said product is between $6\times10^{-2}$ and $15\times10^{-2}$ torr cm.

7. Apparatus according to claim 1 wherein said product is between $9\times10^{-2}$ and $12\times10^{-2}$ torr cm.

8. Apparatus according to claim 1 wherein said inlet orifice is located in an inlet wall of said first chamber, and wherein said means for controlling the kinetic energy of said ions comprises means for applying a low DC voltage between said first rod set and said inlet wall.

9. Apparatus according to claim 1 wherein said inlet orifice is located in an inlet wall of said first chamber, and wherein said means for controlling the kinetic energy of said ions comprises means for applying a low DC voltage between said first rod set and said inlet wall, said low DC voltage being between 1 and 30 volts DC.

10. Apparatus according to claim 1 wherein said inlet orifice is located in an inlet wall of said first chamber, and wherein said means for controlling the kinetic energy of said ions comprises means for applying a low DC voltage between said first rod set and said inlet wall, said low DC voltage being between 1 and 15 volts.

11. Apparatus according to claim 1 wherein said inlet orifice is located in an inlet wall of said first chamber, and wherein said means for controlling the kinetic energy of said ions comprises means for applying a low DC voltage between said first rod set and said inlet wall, said low DC voltage being between 1 and 10 volts.

12. Apparatus according to claim 8 wherein said interchamber orifice is between approximately 1 and 2.5 mm in diameter.

13. Apparatus according to claim 12 wherein said interchamber orifice is approximately 2.5 mm in diameter.

14. A method of mass analysis utilizing a first rod set and a second rod set located in first and second vacuum chambers respectively, said first and second rod sets each comprising a plurality of rod means and defining longitudinally extending first and second spaces respectively located end-to-end with each other and separated by an interchamber orifice so that an ion may travel through said first space, said interchamber orifice and said second space, said method comprising:

(a) producing outside said first chamber ions of a trace substance to be analyzed, (b) directing said ions through an inlet orifice in an inlet wall into said first space, first through said first space, said interchamber orifice and then through said second space, and then detecting the ions which have passed through said second space, to analyze said substance, (c) placing an essentially AC-only RF voltage between the rod means of said first set so that said first rod set acts to guide ions therethrough, through, (d) placing AC and DC voltages between the rod means of said second rod set so that said second rod set acts as a mass filter, (e) admitting a gas into said first chamber with said ions, (f) pumping said gas from said first chamber to maintain the product of the pressure in said first chamber times the length of said first rod set at or greater than $2.25\times10^{-2}$ torr cm but maintaining the pressure in said first chamber below that pressure at which an electrical breakdown would occur between the rods of said first set, (g) pumping gas from said second chamber to maintain the pressure in said second chamber at a substantially lower pressure than that of said first chamber, for effective mass filter operation of said second rod set, (h) and controlling the kinetic energy of ions entering said first rod set to maintain such kinetic energy at a relatively low value, whereby to provide improved transmission of said ions through said interchamber orifice.

15. The method according to claim 14 wherein said product is maintained at or above $3.6\times10^{-2}$ torr cm.

16. The method according to claim 14 wherein said product is maintained at or above $7.5\times10^{-2}$ torr cm.

17. The method according to claim 14, 15 or 16 wherein said product is not greater than about $105\times10^{-2}$ torr cm.

18. The method according to claim 14 wherein said product is maintained at between $3\times10^{-2}$ and $30\times10^{-2}$ torr cm.

19. The method according to claim 14 wherein said product is maintained at between $6\times10^{-2}$ and $15\times10^{-2}$ torr cm.

20. The method according to claim 14 wherein said product is maintained at between $9\times10^{-2}$ and $12\times10^{-2}$ torr cm.

21. The method according to claim 14 wherein said step of controlling the kinetic energy of said ions comprises placing a low DC voltage between the rod means of said first set and said inlet wall.

22. The method according to claim 14 wherein said step of controlling the kinetic energy of said ions comprises placing a low DC voltage between the rod means of said first set and said inlet wall said low DC voltage being between 1 and 30 volts DC.

23. The method according to claim 14 wherein said step of controlling the kinetic energy of said ions comprises placing a low DC voltage between the rod means of said first set and said inlet wall said low DC voltage being between 1 and 15 volts DC.

24. The method according to claim 14 wherein said step of controlling the kinetic energy of said ions comprises placing a low DC voltage between the rod means of said first set and said inlet wall said low DC voltage being between 1 and 10 volts DC.

* * * * *

US004963736B1

REEXAMINATION CERTIFICATE (3768th)

United States Patent [19] [11] B1 4,963,736

Douglas et al. [45] Certificate Issued May 25, 1999

[54] MASS SPECTROMETER AND METHOD AND IMPROVED ION TRANSMISSION

[75] Inventors: Donald J. Douglas, Toronto; John B. French, Oakville, both of Canada

[73] Assignee: MDS Inc., Etobicoke, Canada

Reexamination Request:
No. 90/004,771, Sep. 30, 1997

Reexamination Certificate for:

| | |
|---|---|
| Patent No.: | **4,963,736** |
| Issued: | **Oct. 16, 1990** |
| Appl. No.: | **07/437,047** |
| Filed: | **Nov. 15, 1989** |

[30] Foreign Application Priority Data

Dec. 12, 1988 [CA] Canada ..... 585694

[51] Int. Cl.[6] ..... H01J 49/42

[52] U.S. Cl. ..... 250/292; 250/288; 250/282

[58] Field of Search ..... 250/292, 290, 250/281, 282, 288 A

[56] References Cited

PUBLICATIONS

Schaaf et al., Trapped Ion Density Distribution in the Presence of He–Buffer Gas, Applied Physics, vol. 25, pp. 249–251 (1981) ("Schaaf").

Vedel et al., Influence of space charge on the computed statistical properties of stored ions cooled by a buffer gas in a quadrupole rf trap, 29 Physical Review; vol. 29, No. 4, pp. 2098–2101 (1984) ("Vedel").

Stafford et al., Recent Improvements in and Analytical Applications of Advanced Ion Trap Technology, International Journal of Mass Spectrometry and Ion Processes, vol. 60, pp. 85–98 (1984) ("Stafford article").

Stafford et al., European Patent Application, Publication No. 0 013 207, Jul. 11, 1984 ("Stafford application").

French, John Barry, European Patent Application, Publication No. 0 023 826, Feb. 11, 1981 (French application).

Boitnott et al., *Optimization of Instrument Parameters for Collision Activated Decomposition (CAD) Experiments for a Finnigan Triple Stage Quadrupole GC/MS/MS/DS,* 1981 Pittsburgh Conference On Analytical Chemistry and Applied Spectroscopy, Mar. 9–13, 1981, Abstract No. 782 ("Finnigan abstract").

Boitnott et al., *Optimization of Instrument Parameters for Collision Activated Decomposition (CAD) Experiments for a Triple Stage Quadrupole* (TSQ™ GC/MS/MS/DS, Finnigan Topic 8160 ("Finnigan paper").

Caldecourt et al., An Atmospheric–Pressure Ionization Mass Spectrometer/Mass Spectrometer, International Journal Mass Spectrometry and Ion Physics, vol. 49, pp. 233–251 (1983) ("Caldecourt").

*Primary Examiner*—Jack I. Berman

[57] ABSTRACT

In a mass spectrometer system, ions travel through an orifice in an inlet plate into a first vacuum chamber containing AC-only rods, and then through an orifice into a second vacuum chamber containing a standard quadrupole. The second vacuum chamber is held at low pressure, e.g. 0.02 millitorr or less, but the product of the pressure in the first chamber times the length of the AC-only rods is held above $2.25\times10^{-2}$ torr cm, preferably between $6\times10^{-2}$ and $15\times10^{-2}$ torr cm, and the DC voltage between the inlet plate and the AC-only rods is kept low, e.g. between 1 and 30 volts, preferably between 1 and 10 volts. This produces a large enhancement in ion signal, with less focussing aberration and better sensitivity at high masses, and also allows the use of smaller, cheaper pumps so the system can be more easily transportable.

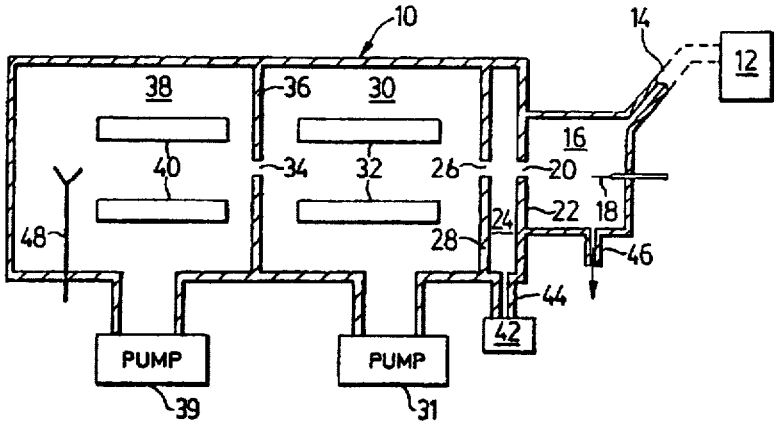

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–24 is confirmed.

New claims 25–30 are added and determined to be patentable.

*25. The mass spectrometer system as set forth in claim 1, wherein a first longitudinal axis of the first rod set intersects a second longitudinal axis of the second rod set.*

*26. The mass spectrometer system as set forth in claim 1, wherein the first rod set is parallel to the second rod set.*

*27. The method as set forth in claim 14, further comprising producing collisions between the ions and the gas in the first chamber for damping a velocity of the ions.*

*28. The method as set forth in claim 14, further comprising producing collisions between the ions and the gas in the first chamber for damping a radial velocity of the ions.*

*29. The method as set forth in claim 14, further comprising producing collisions between the ions and the gas in the first chamber for damping an axial velocity of the ions.*

*30. The method as set forth in claim 14, further comprising producing collisions for forcing the ions closer to a central longitudinal axis of the first rod set.*

* * * * *

US004963736C2

(12) EX PARTE REEXAMINATION CERTIFICATE (7032nd)

United States Patent
Douglas et al.

(10) Number: US 4,963,736 C2
(45) Certificate Issued: Aug. 25, 2009

(54) MASS SPECTROMETER AND METHOD AND IMPROVED ION TRANSMISSION

(75) Inventors: Donald J. Douglas, Toronto (CA); John B. French, Oakville (CA)

(73) Assignee: MDS Inc., Etobicoke, Ontario (CA)

Reexamination Request:
No. 90/008,608, Sep. 25, 2007

Reexamination Certificate for:

| | |
|---|---|
| Patent No.: | **4,963,736** |
| Issued: | **Oct. 16, 1990** |
| Appl. No.: | **07/437,047** |
| Filed: | **Nov. 15, 1989** |

Reexamination Certificate B1 4,963,736 issued May 25, 1999

(30) Foreign Application Priority Data

Dec. 12, 1988 (CA) ..... 585694

(51) Int. Cl.
*H01J 49/34* (2006.01)
*H01J 49/42* (2006.01)

(52) U.S. Cl. ..... 250/292; 250/282; 250/288
(58) Field of Classification Search ..... None
See application file for complete search history.

(56) References Cited

U.S. PATENT DOCUMENTS

| | | | |
|---|---|---|---|
| 1,969,399 | A | 8/1934 | Famsworth |
| 2,939,952 | A | 6/1960 | Paul et al. |
| 3,555,273 | A | 1/1971 | Arnold |
| 3,935,452 | A | 1/1976 | Prince |
| 4,023,398 | A | 5/1977 | French et al. |
| 4,121,099 | A | 10/1978 | French et al. |
| 4,137,750 | A | 2/1979 | French et al. |
| 4,148,196 | A | 4/1979 | French et al. |
| 4,234,791 | A | 11/1980 | Enke et al. |
| 4,423,324 | A | 12/1983 | Stafford |
| 4,535,236 | A | 8/1985 | Batey |
| 4,540,884 | A | 9/1985 | Stafford et al. |
| 4,755,670 | A | 7/1988 | Syka et al. |
| 4,791,292 | A | 12/1988 | Cooks et al. |

FOREIGN PATENT DOCUMENTS

| | | |
|---|---|---|
| CA | 585694 | 12/1988 |
| EP | 23826 A1 * | 2/1981 |
| EP | 0023826 B1 | 3/1984 |
| EP | 0113207 A2 | 7/1984 |

OTHER PUBLICATIONS

V.I. Baranov & S. Tanner, A dynamic reaction cell for inductively coupled plasma mass spectrometry (ICP–DRC–MS): Part 1. The rf–field energy contribution in thermodynamics of ion–molecule reactions, J. Anal. At. Spectrom., vol. 14, pp. 1133–1142 (1999).

M. Barber et al., "Fast atom bombardment of solids as an ion source in mass spectrometry", Nature, vol. 293, pp. 270–275 (1981).

(Continued)

*Primary Examiner*—Albert J Gagliardi

(57) ABSTRACT

In a mass spectrometer system, ions travel through an orifice in an inlet plate into a first vacuum chamber containing AC-only rods, and then through an orifice into a second vacuum chamber containing a standard quadrupole. The second vacuum chamber is held at low pressure, e.g. 0.02 millitorr or less, but the product of the pressure in the first chamber times the length of the AC-only rods is held above $2.25\times10^{-2}$ torr cm, preferably between $6\times10^{-2}$ and $15\times10^{-2}$ torr cm, and the DC voltage between the inlet plate and the AC-only rods is kept low, e.g. between 1 and 30 volts, preferably between 1 and 10 volts. This produces a large enhancement in ion signal, with less focussing aberration and better sensitivity at high masses, and also allows the use of smaller, cheaper pumps so the system can be more easily transportable.

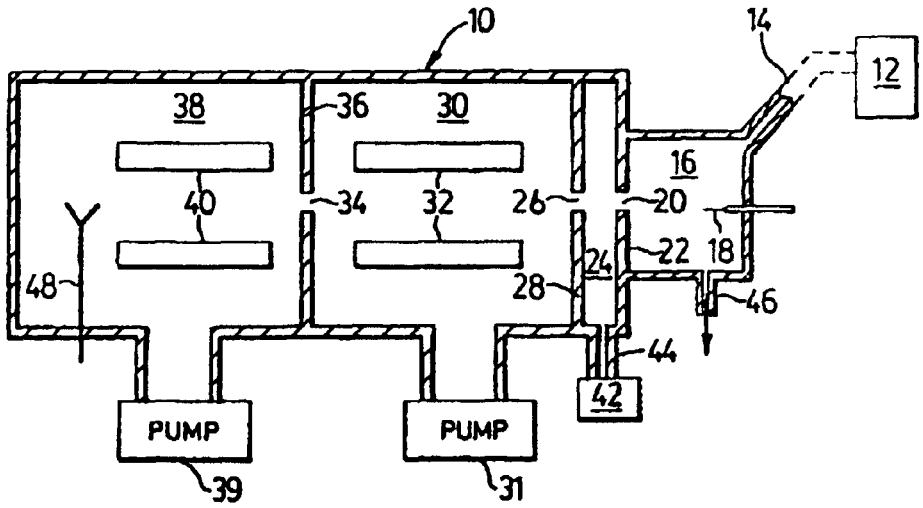

OTHER PUBLICATIONS

J.H. Batey et al., "The Study of Ion–Molecule Reactions in the Gas Phase using a Triple Quadrupole Mass Spectrometer. Part 1. The Reactions of CH3+, CD3+, and C2H5+ with Simple Olefins", J. Chem. Soc. Perkin Trans. II, pp. 1263–1267 (1983).
C. Beaugrand et al., "Ion Confinement in the Collision Cell of a Multiquadrupole Mass Spectrometer: Access to Chemical Equilibrium and Determination of Kinetic and Thermodynamic Parameters of an Ion–Molecular Reaction", Am. Chem. Soc., vol. 61, pp. 1447–1453 (1989).
K. Birkinshaw et al., "The focusing of an ion beam from a quadrupole mass filter using an electrostatic octopole lens", J. Phys. E: Sci. Instrum., vol. 11, pp. 1037–1040 (1978).
J.A. Buckley et al., TAGA 6000—A New Triple Quadrupole MS/MS System for the Rapid Ultrasensitive Screening for Trace Contaminants, Abstracts, 1981 Pittsburgh Conference on Analytical Chemistry and Applied Spectroscopy, No. 783.
D.A. Church, "Storage–Ring Ion Trap Derived from the Linear Quadrupole Radio–Frequency Mass Filter", J. Appl. Phys., vol. 40, No. 8, pp. 3127–3134 (1969).
J.S. Crain et al., "Matrix interferences in inductively coupled plasma–mass spectrometry: some effects of skimmer orifice diameter and ion lens voltages", Spectrochimica Acta, vol. 43B, Nos. 9–11, pp. 1355–1364 (1988).
P.H. Dawson et al., "The Use of Triple Quadrupoles for Sequential Mass Spectrometry: 2–A Detailed Case Study", Organic Mass Spectrom., vol. 17, No. 5, pp. 212–219 (1982).
H. Dawson & D.J. Douglas, "Quantitative Studies of the Kinetics of Ion Dissociation and Ion Molecule Declustering Using a Triple Quadrupole", Proc. 29th Ann. Conf. on Mass Spectrometry (1981).
G.G. Dolnikowski et al., "Ion–Trapping Tecnique for Ion/Molecule Reaction Studies in the Center Quadrupole of a Triple Quadrupole Mass Spectrometer", Int'l J. Mass Spectrom. & Ion Processes, vol. 82, pp. 1–15 (1988).
D.J. Douglas, "Some Current Perspectives on ICP–MS", Canadian J. Spectroscopy, vol. 34, pp. 38–49 (1989).
K.M. Ervin & P.B. Armentrout, "Translational energy dependence of Ar++XY ARXt +Y (XY=H2, D2, HD) from thermal to 30 eV c.m.", J. Chem Phys., vol. 83, pp. 166–189 (1985).
W. Frobin, et al., "Ion–molecule reactions of N+ with CO: Integral reactive cross sections in the collision energy range 0.2–13 eV", Fakultät für Physik der Univeersität, D7800 Friburg, West Germany (1977).
D. Gerlich, "Dynamics of ion–molecule collisions at very low energies: Molecular beams, crossed and merged with guided ion beams", in XII International Symposium on Molecular Beams, pp. 37–40 (V. Aquilanti ed., 1989).
D. Gerlich, "Low Energy Ion Reactions Measured with Guided Beams", in Electronic and Atomic Collisions, pp. 541–553 (D.C. Lorents et al. eds., 1986).
D. Gerlich & M. Wirth, "Low Energy Crossed –Beam Study of the Reaction N+=02 NO++O", in Symposium on Atomic and Surface Physics, pp. 366–371 (F. Howorka ed., 1986).
G.W. Goodrich & W.C. Wiley, "Continuous Channel Electron Multiplier", 33 Rev. Sci. Instrum., vol. 33, pp. 761–762 (1962).
R.S. Houk, "Mass Spectrometry of Inductively Coupled Plasmas", Analytical Chem., vol. 58, No. 1, pp. 97–105 A (1986).
H.I. Kenttamaa et al., "Scanning a Triple Quadrupole Mass Spectrometer for Doubly charged Ions", Organic Mass Spectrometry, vol. 18, No. 12, pp. 561–566 (1983).
F.L. King & W.W. Harrison, "Collision–Induced Dissociation of Polyatomic Ions in Glow Discharge Mass Spectrometry", Int'l J. Mass Spectrom. & Ion Processes, vol. 89, pp. 171–175 (1989).
F.L. King et al., "Study of Molecular Interferences in Glow Discharge Mass Spectrometry", J. Analytical At. Spectrom., vol. 3, pp. 883–886 (1988).
R. Kostiainen, "Characterization of Trichotecenes by Tandem Mass Spectrometry Using Reactive Collisions with Ammonia", Biomedical & Environmental Mass Spectrometry, vol. 16, pp. 197–200 (1988).
J.F. Mahoney et al., "Improving the Detection Sensitivity for High Mass Ions", Proc. 36th ASMS Conference on Mass Spectrometry and Allied Topics, 1988.
W. McFadden, "Techniques of Combined Gas Chromatography Spectrometry: Applications in Organic Analysis", pp. 51–52 (1973).
L.A. Powell & G.M. Hieftje, "Computer Identification of Infrared Spectra by Correlation–Based File Searching", Analytica Chimica Acta, vol. 100, pp. 313–327 (1978).
A.E. Schoen & J. E.P. Syka, "Improvement in High Mass Ion Detection of a Tandem Quadrupole Mass Spectrometer Using a High Voltage Post–Acceleration Detector", Proc. 36th ASMS Conference on Mass Spectrometry and Allied Topics, 1988.
J.T. Rowan & R.S. Houk, "Attenuation of Polyatomic Ion Interferences in Inductively Coupled Plasma Mass Spectrometry by Gas–Phase Collisions", Applied Spectroscopy, vol. 43, No. 8, pp. 976–980 (1989).
S. Scherbarth & D. Gerlich, "Energy partitioning on Ar++02 collisons at low energies: Analysis of product states by iaser–induced predissociation", J. Chem. Phys., vol. 90, No. 3, pp. 1610–1623 (1989).
J.R.B. Slayback et al., "Determination of Metipranolol in Serum by Triple Stage Quadrupole (TSQ)TM GCMSM-SIDS", Finnigan Topic 8 161, presented at 1981 Pacific Conference on Chemistry and Spectroscopy.
I. Szabo, "New Ion–Optical Devices Utilizing Oscillatory Electric Fields. I. Principle of Operation and Analytical Theory of Multiple Devices with Two–Dimensional Electric Fields", Int. J. Mass Spec. Ion Proc., vol. 73, pp. 197–235 (1986).
E. Teloy, "Proton–Hydrogen (H2, D2) differential Inelastic and Reactive Scattering at Low Energies", in Electronic and Atomic Collisions, pp. 590–603 (G. Watel ed., 1978).
P.E. Walters & C.A. Barnardt, "The role of desolvation and hydrogen addition on the excitation features of the inductively coupled plasma", Spectrochimica Acta, vol. 43B, pp. 325–337 (1988).
Finnigan MAT, Models TSQ–45AITSQ–46A: GCMSN-SIDS Systems (1984).
Finnigan MAT, Price Information: New Option for TSQO 45, TSQO 46 (1986).
Sciex TM TAGA TM 6000 MS/MS: A High Performance Tandem Mass Spectrometer System (1981).
TAGA 6000E MS/MS System Operators Manual, Nov. 1987 (PE0022062–PE0022229).
TAGA 6000M MSIMS Mobile Laboratory Specifications (PE0022342–PE0022370).
TAGA 6000 MS/MS, A High Performance Tandem Mass Spectrometer System (© 1981 SCIEX) (MM00881–00886).

A.P. Bruins & C. Beaugrand, "LC/MS with Atmospheric Pressure Ionization Using the NERMAG R 30–10 Triple Quadrupole Mass Spectrometer," 36$^{th}$ ASMS Conference On Mass Spectrometry (Jun. 1988).

R.A. Yost & C.G. Enke, "A Triple Quadrupole Mass Spectrometer for Direct Mixture Analysis & Structure Elucidation," 27$^{th}$ ASMS Conference Proceeding, 461–462 (1979).

M. Mosharra & H.J. Oskarn, "Application of Mass Spectrometry to the Study of Gaseous Plasmas," Physica 32, pp. 1759–1765 (1966).

W.M. Brubaker & W.S. Chamberlin, "Operation of Quadrupole Mass Filter at High Pressure," Abstracts Of 17$^{th}$ Annual Conf. On Mass Spectrometry and Allied Topics (1969).

J. Visser, "Mass Spectrometric Analysis of the Sputter Gas Atmosphere Without Pressure Reduction System," J. Vacuum Science Technol., vol. 10, No. 3, pp. 464–471 (1973).

J.N. Louris, et al., "Instrumentation, Applications, and Energy Deposition in Quadrupole Ion–Trap Tandem Mass Spectrometry," Anal. Chem., vol. 59, No. 13, pp. 1677–1685 (1987).

J.A. Buckley, et al., "TAGA 6000—A New Triple Quadrupole MS/MS System for the Rapid Ultrasensitive Screening of Trace Contaminants," Abstracts Of The 1981 Pittsburgh Conference, No. 783.

P.H. Dawson, et al., "The Use of Triple Quadrupoles for Sequential Mass Spectrometry," Organic Mass Spectrometry, vol. 17, No. 5, pp. 205–219 (1982).

P.H. Dawson, "The Effects on Ion Motion in Quadrupole Fields,"International Journal Of Mass Spectrometry and Ion Physics, 24, pp. 447–451 (1977).

P.H. Dawson & J.E. Fulford, "The Effective Containment of Parent Ions and Daughter Ions in Triple Quadrupoles Used for Collisional Dissociation," International Journal Of Mass Spectrometry and Ion Physics, 42, 195–211 (1982).

B. Hu & J. Qiu, The Nonlinearity of Upper Limiting Pressure for Quadrupole Mass Spectrometers, Journal Of Vacuum Science And Technology, vol. 5, No. 4, pp. 2657–2660 (1987).

L. Hanley et al, "Collision–Induced Dissociation of Aluminum Cluster Ions: Fragmentation Patterns, Bonds Energies, and Structures for A/2–A17," J. chem. phys., vol. 87, No. 1, pp. 260–268 (1987).

R.A. Yost and C.G. Enke, "Selected Ion Fragmentation with a Triple Quadrupole Mass Spectrometer," NTIS Rep. ADA089824, Dept. of Chemistry, Michigan State University (1980).

R.A. Yost, "Selected Ion Fragmente with a Triple Quadrupole Mass Spectrometer," Dissertation Submitted to Michigan State University, Dept. of Chemistry (1979).

M.A. Mosharrafs & H.J. Oskam, A Quadrupole Mass Spectrometer for Isotope Ratio Studies of Plasma Constituents, 12$^{th}$ ASMS and Allied Topics, 1964, pp. 473–478 (1964).

D.F. Hunt, et al, "Collision Activated Decompositions of Negative Ions in Mixture Analysis with a Triple Quadrupole Mass Spectrometer," Anal. Chem. vol. 52, No. 3, pp. 386–390 (1980).

H. Kirby, et al, "Data Systems for Tandem Mass Spectrometry," Tandem Mass Spectrometer (edited by F.W. McLafferty) John Wiley & Sons, pp. 337–352 (1983).

K.G. Günther & W. Hänlein, "The Mass Filter Partial–Pressure Vacuum Gauge," Trans. Vac. Symp. 2$^{nd}$ Int. Congress, 8$^{th}$, 1961, pp. 573–580 (Pergamon Press 1962).

J.D. Ciupek, "Tandem Mass Spectrometry: Applications and New Instrumentation," A Thesis Submitted to the Faculty of Purdue University, Dec. 1984.

P.H. Dawson, "Collisionally Activated Dissociation of O2+ in a Triple Quadrupole and the Role of Excited States," 63 International Journal Of Mass Spectrometry And Ion Processes, pp. 305–314 (1985).

H.G. Dehmelt, "Radiofrequency Spectroscopy of Stored Ions I: Storage", Adv. At. Phys., vol. 3, pp. 53–72 (1967).

R.F. Bonner, et al, "Effect of Charge Exchange Reactions on the Motion of Ions in Three–Dimensional Quadrupole Electric Fields," International Journal Of Mass Spectrometry And Ion Physics, vol. 22, pp. 17–34 (1976).

R.F. Bonner & R.E. March, "The Effects of Charge Exchange Collisions on the Motion of Ions in Three–Dimensional Quadrupole electric Fields. Part 11. Program Improvements and Fundamental Results," International Journal Of Mass Spectrometry And Ion Physics, vol. 25, pp. 411–431 (1977).

P.H. Dawson, "Energetics of Ions in Quadrupole Fields", International Journal Of Mass Spectrometry and Ion Physics, vol. 20, pp. 237–245 (1976).

P.H. Dawson, "Performance of the quadrupole mass filter with separated RF and DC fringing fields," International Journal Of Mass Spectrometry And Ions Physics, vol. 25, pp. 375–392 (1977).

P.H. Dawson, "Experimental measurements of quadrupole mass analyzer performance and comparison with theoretical predictions", International Journal Of Mass Spectrometry And Ion Physics, vol. 21, pp. 317–332 (1976).

G.K. Koyanagi et al, "N20: a case study for acceleration region kinetics in a double–focusing mass spectrometer with a conventional Nier–type ion source," International Journal Of Mass Spectrometry and Ion Processes, vol. 87, pp. 249–274 (1989).

D.J. Douglas, "Mechanism of the collision–induced dissociation of polyatomic ions studied by triple quadrupole mass spectrometry," Journal Of Physical Chemistry, vol. 86, No. 2, pp. 185–191 (1982).

S. Mastoris, "The Three–Dimensional Quadrupole Mass Spectrometer," University of Toronto Institute of Aerospace Studies, Tech. Note 172, Toronto, Canada, 1972.

P.H. Dawson et al, "Mass Spectroscopy Using RF Quadrupole Fields," 27 Advan. Electron. Electron Phys., pp. 59–185 (1969).

P.H. Dawson, "Quadrupole Mass Spectrometry and Its Applications", Elsevier: Amsterdam, pp. 121–152 (1976).

P.H. Dawson & N.R. Whetten, "Quadrupoles Monopoles and Ion Traps," Research/Development vol. 19, No. 2, 46–50 (1968).

E.D. Courant et al, "The Strong–Focusing Synchrotron: A New High Energy Accelerator," Physical Review, vol. 88, No. 5, pp. 1190–1196 (1952).

W. Paul, et al., "The Electric Mass Filter as a Mass Spectrometer and Isotope Separator", 152 Zeitschrift Fur Physik143–182 (1958).

R. Gradewald, "The Behaviour of Charged Particles in Electrical Quadrupole Fields," 20 Annals Of Physics 1 (1967).

R.F. Wuerker, et al., "Electrodynamic Containment of Charged Particles", Journal Of Applied Physics, vol. 30, No. 1, pp. 342–349.

V.P. Kubicek & L. Mrahzek, "Theoretical Analysis of the Influence of Collisions of Ions in the Quadrupole Mass Spectrometer", Annals Of Physics, vol. 24, ed. 7/8, (Liepzig) 289 (1970).
J.P. Schermann & F.G. Major, "Heavy Ion Plasma Confinement in a R.F. Quadrupole Trap," Goddard Space Flight Center, Greenbelt, MD, NASA Report, X–524–71–343 (1971).
U. Von Zahn & H. Tatarczyk, "Metastable Molecule Ions with Lifetimes in the 100 μSec Region," Physics Letters, vol. 12, No. 3, pp. 190–191 (1964).
J. Andre & J.P. Schermann, "Linear Model of Confinement of Charged Particles in a Quadrupole R.F. Field in Presence of Buffer Gases," Physics Letters, vol. 45A, No. 2, pp. 139–140 (1973).
A.G. Harrison, et al, "A Hybrid Beqq Mass Spectrometer for Studies in Gaseous Ion Chemistry." Intl. J. Mass Spectrom. and Ion Processes, vol. 74, pp. 13–31 (1986).
M.L. Vestal & J.H. Futrell, "Photodissociation of and CH3C1+ and CH3Br+ in a Tandem Quadrupole Mass Spectrometer", Chemical Physics Letters, vol. 28, No. 24, pp. 559–561 (1974).
D. C. McGilvery & J.D. Morrison, "A Mass Spectrometer for the Study of Laser–Induced Photodissociation of Ions," International Journal Of Mass Spectrometry and Ion Physics, vol. 28, pp. 81–92 (1978).
R.A. Yost & C.G. Enke, "Selected Ion Fragmentation with a Tandem Quadrupole Mass Spectrometer," Journal Of The American Chemical Society, 100:7, pp. 2274–2275 (1978).
R.A. Yost, et al, "High Efficiency Collision–Induced Dissociation in an RF–Only Quadrupole," International Journal Of Mass Spectrometry And Ion Physics, vol. 30, pp. 127–136 (1979).
R.D. Smith et al., "Capillary Zone Electrophoresis—Mass Spectrometry Using an Electrospray Ionization Interface", Anal. Chem. , vol. 60, No. 5, pp. 436–441 (1988).
M. Mosharrafa & H. Oskam, "Application of Mass Spectrometry to the Study of Gaseous Plasmas", Physica 32, pp. 1759–1765 (1966).
V. Caldecourt et al., "An Atmospheric Pressure Ionization MS/MS and its Applications", ASMS Abstract, pp. 668–669 (1981).
W. R. Carr & J.J. Thomson, "On The Laws Governing Electric Discharges in Gases at Low Pressures", Phil. Trans. A, vol. 201, pp. 403–433 (1983).
E. Teloy & D. Gerlich, Integral Cross Sections For Ion–Molecule Reactions. 1. The Guided Beam Technique, Chemical Physics, pp. 417–427 (1974).
J. H. Futrell & L.H. Wojcik, "Modification of High Resolution Mass Spectrometer for Chemical Ionization Studies", Review of Scientific Instruments, vol. 42, No. 2, pp. 244–251 (1971).
J. E Fulford, et al, "Gas Phase Ion–Molecule Reactions of Dimethylsulphoxide", Canadian Journal of Chemistry, vol. 56, No. 17, pp. 2324–2330 (1978).
J.E. Camapana & P. C. Jurs, "Computer Simulation of the Quadrupole Mass Filter", International Journal of Mass Spectrometry and Ion Phsysics, 33, pp. 119–137 (1980).
M.A. Armitage et al., "Methylketene. Ion Chemistry and Proton Affinity", Journal of American Society, vol. 102, No. 5, pp. 5064–5068 (1980).
A.H.Grange, "Discharge Suppression System for a Double, Focusing, Atmospheric Pressure Ionization Spectrometer", Rev. SCI. Instrum., vol. 59, No. 4, pp. 656–659 (1988).
D. Gerlich et al., "Ion Trap Studies of Association Processes in Collision of CH+3 and CD+3 with n–H2, P–H2, D2 and He at 8O K", The Astrophysical Journal, vol. 347, No. 2, pp. 849–854 (1989).
V.J. Caldecort, D. Zakett, J.C. Tou, "An Atmospheric–Pressure Ionization Mass Spectrometer/Mass Spectrometer," International Journal of Mass Spectrometry and Ion Physics, 49 (1983) 233–251.
J.A. Olivares, N.T. Nguyen, C.R. Yonker, R.D. Smith, "On–Line Mass Spectrometric Detection for Capillary Zone Electrophoresis," Analytical Chemistry, 59 (1987) 1230–1232.
C.A. Boitnott, U. Steiner, J.R.R. Slayback "Optimization of Instrument Parameters for Collision Activated Decomposition (CAD) Experiments for a Finnigan Triple Stage Quadrupole GC/MS/MS/DS," 1981 Pittsburgh Conference on Analytical Chemistry and Applied Spectroscopy, Mar. 9–13, 1981, Abstract No. 782.
H. Schaaf, U. Schmeling, G. Werth, "Trapped Ion Density Distribution in the Presence of He–Buffer Gas", Appl. Phys. 25, (1981) 249–251.
G.C. Stafford, Jr., P.E. Kelley, J.E.P. Syka, W.E. Reynolds, J.F.J Todd, "Recent Improvements In and Analytical Applications of Advanced Ion Trap Technology," International Journal of Mass Spectrometry and Ion Processes, 60 (1984) 85–98.
Finnigan MAT—Triple Stage Quadrupole (TSQ)—Operator's Manual—Jun. 30, 1994.
R.F. Bonner, J.E. Fulford and R.E. March, "The Cylindrical Ion Trap. Part I. General Introduction", Interntl. J. of Mass Spec. and Ion Phys., 24 (1977) 255–269.
J. E. Fulford et al., "Cylindrical Ion Trap: A Theoretical and Experimental Study", Canadian J. of Spectrometry, vol. 25 No. 4 (1980) 85–97.
Hanley, Luke and Anderson, Scott L, "Chemistry and Cooling of Transition Metal Cluster Ions," Chemical Physics Letters, vol. 122, No. 4, pp. 410–414, 1985 ("Anderson I").
Anderson, Scott L. and Hanley, Luke, "Metal Cluster Ion Chemistry," SPIE vol. 669 Laser Applications in Chemistry, pp. 133–136, 1986 ("Anderson II").
Boitnott, C.A., et al., "Optimization of Instrument Parameters for Collision Activated Decomposition (CAD) Experiments for a Triple State Quadrupole (TSQ™) GC/MS/MS/DS," Finnigan Topic 8160 ("Finnigan paper").
Johnston, Mark, "Energy Filtering in Triple Quadrupole MS/MS" 1984 (the "Finnigan application report").
"Triple Stage Quadrupole GC/MS/MS/DS System," 1981, describing the Finnigan TSQ mass spectrometer ("Finnigan data sheet").
Engineering Drawings of Collision Cell for Finnigan TSQ mass spectrometer ("Finnigan schematics").

* cited by examiner

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–30 is confirmed.

* * * * *